US006183374B1

(12) United States Patent
Onuki et al.

(10) Patent No.: US 6,183,374 B1
(45) Date of Patent: Feb. 6, 2001

(54) GOLF CLUB

(75) Inventors: Masahide Onuki; Makoto Yoshida, both of Hyogo (JP)

(73) Assignee: Sumitomo Rubber Industries, Ltd., Hyogo (JP)

( * ) Notice: Under 35 U.S.C. 154(b), the term of this patent shall be extended for 0 days.

(21) Appl. No.: 09/090,211

(22) Filed: Jun. 4, 1998

(30) Foreign Application Priority Data

Jun. 4, 1997 (JP) ..... 9-146950
Sep. 22, 1997 (JP) ..... 9-256376
Mar. 19, 1998 (JP) ..... 10-070986

(51) Int. Cl.[7] ..... A63B 53/10

(52) U.S. Cl. ..... 473/289; 473/319; 273/DIG. 7; 273/DIG. 23

(58) Field of Search ..... 473/316–323, 473/289; 273/DIG. 7, DIG. 23

(56) References Cited

U.S. PATENT DOCUMENTS 3,897,065 * 7/1975 Solheim ..... 473/349
4,854,580 * 8/1989 Kobayashi ..... 473/290
5,242,721 * 9/1993 Oonuki ..... 473/319
5,348,777 * 9/1994 Oonuki ..... 473/319

* cited by examiner

*Primary Examiner*—Jeanette Chapman
*Assistant Examiner*—Stephen L. Blau
(74) *Attorney, Agent, or Firm*—Birch, Stewart, Kolasch & Birch, LLP

(57) ABSTRACT

A golf club shaft formed partially of an anisotropic material such that a part of a fibrous angle of the anisotropic material and/or an orientation angle thereof is differentiated from other portions thereof partly in the circumferential direction of the golf club shaft and in at least one portion in a thickness direction thereof to deviate a principal elastic axis of the golf club shaft and a principal geometrical axis thereof from each other. When a plane parallel with an intersection line formed by the intersection of a front face of a club head and a horizontal plane and including the principal geometrical axis of the golf club shaft is set as a specified plane, the principal elastic axis of the golf club shaft is so positioned that a plane including the principal elastic axis and the principal geometrical axis intersect with the specified plane at an intersection angle of 45°–90°, with a region of 200 mm of the golf club shaft with respect to an end at a grip side thereof fixed.

10 Claims, 35 Drawing Sheets

(A)

(B)

(A)

(B)

(A)

(B)

(A)

(B)

GOLF CLUB

BACKGROUND OF THE INVENTION

1. Field of the Invention

In general, the present invention relates to a golf club and especially the shaft thereof. More especially, the present invention relates to a golf club shaft which is twisted to correct the direction of the front face of a club head installed on the front end thereof such that the front face of the head club is substantially coincident with the direction in which the golf ball should fly and to a golf club comprising the golf club shaft. Thus, a player can swing the golf club without being conscious of the correction of the player's swinging form.

2. Description of the Related Art

The orbits of golf clubs are different according to players because the player's swinging forms are different from one another. It is not easy to fly the golf ball in the aimed direction: In hitting a golf ball without being conscious of correcting the player's swinging form, even though the player thinks that the player has hit the ball by directing the front face of the head to the direction in which the golf bail should fly, at the time of impact of the golf ball on the head, thc front face of the head is liable to be directed to directions different from the direction in which the ball should fly. This tendency is found outstandingly in beginners who have not had much experience in playing golf and have not corrected their swinging forms appropriately: Normally, at the time of the impact of the golf ball on the club head, the front face of the club head deviates in the almost same direction from the direction in which the golf ball should fly.

Although a slicer thinks that the slicer has hit a golf ball (B) by directing the front face of the club head to the direction in which the golf ball (B) should fly, the arrival time of a toe side 112A of a club head at the golf ball (B) is liable to lag behind the arrival time of a heel side 112B thereof at the golf ball (B), as shown in FIG. 39A. Thus, many of the golf balls (B) hit by the slicer slice, as the name implies. For example, in the case of a right-handed player, many golf balls (B) slice to the right, whereas in the case of a left-handed player, many golf balls (B) slice to the left. Similarly, although a hooker thinks that the hooker has hit the golf ball (B) by directing the front face of the club head to the direction in which the golf ball (B) should fly, the toe side 112A of the club head is liable to arrive at the golf ball (B) earlier than the heel side 112B, as shown in FIG. 39B. Thus, many of the golf balls (B) hit by the hooker hook, as the name implies. For example, in the case of a right-handed player, many golf balls (B) hook to the right, whereas in the case of a left-handed player, many golf balls (B) hook to the left.

When a player who swings the golf club comparatively appropriately uses an iron club, in some cases, the direction of the front face of the head deviates from the direction in which the golf ball should fly at the time of impact of the club head on the golf ball as in the case of the slicer or the hooker. That is, because the shaft of the iron club of the low-number side is longer than that of the iron club of the high-number side, it is difficult for the player to swing the club or the low-number side appropriately. Further, the loft (loft angle) of the shaft of the iron club of the low-number side is smaller than that of the shaft of the iron club of the high-number side. Thus, the player cannot give the golf ball a spin and cannot fly the golf ball high unless the player swings the iron club of the low-number side with a considerable great force. As such, many golfers have the problem that they cannot fly the golf ball longer than they expect when they hit it with the iron club of the low-number side. Thus, to fly the ball long, they apply a greater force than is required to the upper part of their bodies. As a result, their bodies turn forward much faster than their wrists. Consequently, right-handed golfers often fly the golf ball toward the right with respect to the target point. Likewise, left-handed golfers often fly the golf ball toward the left with respect to the target point. On the other hand, because the shaft of the golf club of the high-number side is shorter than that of the club of the low-number side, the golfer's hands pass close to the body when they swing it and the golfers are liable to turn their wrists forward faster than their bodies. Consequently, right-handed golfers often fly the golf ball toward the left with respect to the target point. Likewise, left-handed golfers often fly the golf ball toward the right with respect to the target point. That is, the golfers are liable to hook the golf ball. The tendency is found even in many middle-grade or high-grade golfers.

Needless to say, in order for the golfer to improve the score, it is necessary to hit the golf ball straight in the direction the golfer has aimed. Therefore, it is necessary for the slicer and the hooker to correct their swinging forms. But it is very difficult for them to correct their swinging forms.

A misshot which occurs in using the iron club is caused by the fact that the orientation of the front face of the club head in addressing the golf ball is not coincident with that of the front face of the club head in hitting it. This is because the lengths of the shafts of the iron clubs constituting a set of iron clubs are different from one another, depending on the numbers of the iron clubs, as described above. However, it is not easy to increase the swinging speed in hitting the ball with the club of the low-number side without applying a greater force than is required to the upper part of the golfer's body. Further, it is not easy to appropriately change the golfer's swinging form when the golfer swings the club of the low-number side and the club of the high-number side in consciousness of the variation between the orbit of the club of the low-number side and that of the club of the high-number side. That is, not only the slicer or the hooker, but also many middle-grade or high-grade golfers who swing the club comparatively appropriately have the problem of misshots which occur when they use the iron club.

SUMMARY OF THE INVENTION

The present invention has been made in view of the above-described situation. Accordingly, it is an object of the present invention to allow the direction of the front face of a club head installed on an end of a golf club shaft to be substantially coincident with the direction in which a golf ball should fly, even though a slicer and a hooker swing the golf club shaft without being conscious of correcting their swinging forms.

It is another object of the present invention to allow even golfers who swing a golf club comparatively appropriately to reduce the number of misshots in using an iron club.

In solving the problem, the present invention has been made based on the present applicant's knowledge disclosed previously in U.S. Pat. No. 5,348,777.

That is, a hollow or solid shaft is formed of an anisotropic material such as fiber reinforced resin provided at least one portion thereof. In the shaft, a part of the fibrous angle of the anisotropic material is differentiated from other portions of the anisotropic material in the circumferential direction of the shaft and at least one part of the fibrous angle of the anisotropic material is differentiated from other portions thereof in the thickness direction of the shaft. In this construction, the principal elastic axis of the shaft can be allowed to be uncoincident with the principal geometrical axis thereof and set at a desired position.

For example, in a pipe-shaped structure 10 consisting of fiber reinforced resin shown in FIGS. 40 through 43, supposing that a columnar coordinate [(r, θ, Z) coordinate] is so set as to be coincident with the principal geometrical axis (G) of the pipe-shaped structure 10, an angle (fibrous angle) $\alpha_1$ of a fiber (F) with respect to the principal geometrical axis (G) (namely, Z-axis) is set to 30° in a region 10*a* of $0° \leqq \theta < 180°$, irrespective of the value of the Z-axis and the r-axis, and a fibrous angle $\beta_1$ with respect to the principal geometrical axis (G) is set to −30° in a region 10*b* of $180° \leqq \theta < 360°$, irrespective of the value of the Z-axis and the r-axis. The principal elastic axis (E) of the pipe-shaped structure 10 is not coincident with the principal geometrical axis (G), thus passing through a point (Q) spaced at a certain distance from the principal geometrical axis (G). As shown in FIG. 44, the pipe-shaped structure 10 is fixed at its one side end 10*c* is free and its another side end 10*d* is fixing such that the point (Q) deviates from the vertical direction of the principal elastic axis (E). In this state, when a load is applied downward to the pipe-shaped structure 10 at a position thereof which does not pass the point (Q) located on the principal elastic axis (E), the pipe-shaped structure 10 is deflected and twisted, as shown in FIGS. 45 and 46.

On the other hand, when the load is applied to the pipe-shaped structure 10 at a position thereof which passes the point (Q) located on the principal elastic axis (E), the pipe-shaped structure 10 is deflected but not twisted, as shown in FIGS. 47 and 48.

The present invention has solved the problem by applying a particular deformation behavior of the pipe-shaped structure 10 formed of the anisotropic material to a golf club shaft.

The present invention provides a golf club shaft formed partially of an anisotropic material consisting of at least one of fiber reinforced resin, fiber reinforced rubber, and orientative rubber or a plurality thereof combined with each other such that a part of a fibrous angle of the anisotropic material and/or an orientation angle thereof is differentiated from other portions thereof partly in the circumferential direction of the golf club shaft and in at least one portion in a thickness direction thereof. When a plane parallel with an intersection line formed by the intersection of a front face of a club head and a horizontal plane and including a principal geometrical axis of the golf club shaft is set as a specified plane, with a golf club assembled from the golf club shaft and the club head installed on a leading end thereof placed in a predetermined state on the horizontal plane, the principal elastic axis of the golf club shaft is so positioned that a plane including the principal elastic axis and the principal geometrical axis intersect with the specified plane at an intersection angle of 45°–90°, with a region of 200 mm of the golf club shaft with respect to an end at a grip side thereof fixed.

That the golf club is placed on the horizontal plane in a predetermined state means the state in which as shown in FIGS. 1 and 2, a club head 14 is so placed on the ground (horizontal plane H) that a bottom surface 12*b* thereof is in contact therewith and that the golf club has a predetermined lie angle γ and a predetermined loft angle δ. FIGS. 1 and 2 show the club head of wood type, but this is applicable to an iron head.

Because the shaft is so constructed that the principal elastic axis of the shaft and the principal geometrical axis thereof deviate from each other with the intersection angle formed therebetween, it is deflected and twisted owing to the toe-down of the club head caused by a centrifugal force generated by the swing. When the space in the periphery of the club head is divided into a head front face-side space and a head rear face-side space, with the specified plane set as the boundary therebetween, a principal elastic axis of the golf club shaft is positioned in the head rear face-side space. In this construction, in the case of the orbit of the golf club swung by a slicer, the arrival time of the toe side of the club head at a hitting position is liable to lag behind the arrival of the heel side thereof at the hitting position. But the deflection and the twist of the shaft cause the orbit of the golf club swung by the slicer to be so corrected that the front face of the club head is oriented appropriately to a golf ball. On the other hand, the principal elastic axis of the golf club shaft is positioned in the head front face-side space. In the orbit of the golf club swung by a hooker, the arrival time of the heel side of the club head at a hitting position is liable to lag behind the arrival of the toe side thereof at the hitting position. But the deflection and the twist of the shaft cause the orbit of the golf club swung by the hooker to be so corrected that the front face of the club head is oriented appropriately to the golf ball. Accordingly, at the time of impact of the club head mounted on the leading end of the golf club shaft on the golf ball, the slicer and the hooker can so hit the golf ball that the front face of the club head is directed to substantially the aimed direction (direction in which the golf ball should fly) without the slicer and the hooker being conscious of the correction of their singing form. That is, the slicer and the hooker can hit the golf ball straight.

It is preferable that the intersection angle is 80°–90°. This construction allows the effect of correcting the orientation of the front face of the club head to be outstandingly displayed owing to the twist of the shaft.

The golf club shaft having the above construction can be used for the wood type club and the iron club.

There is provided a set of iron clubs including a plurality of iron clubs of different numbers. At least a part of a golf club shaft of at least one iron club is formed of an anisotropic material consisting of at least one of fiber reinforced resin, fiber reinforced rubber, and orientative rubber or a plurality thereof combined with each other such that a part of a fibrous angle of the anisotropic material and/or an orientation angle thereof is differentiated from other portions of the anisotropic material in the circumferential direction of the golf club shaft and at least one portion thereof in a thickness direction thereof. A specified plane parallel with an intersection line formed by the intersection of a front face of the club head and a horizontal plane and including a principal geometrical axis of the shaft intersects with a plane including the principal elastic axis and the principal geometrical axis at an intersection angle of 45°–90°, with a region of 200 mm of the golf club shaft with respect to an end at a grip side thereof fixed when the golf club is placed in a predetermined state on the horizontal plane. That the golf club is placed on the horizontal plane in a predetermined state means the state in which as shown in FIGS. 3 and 4, an iron club head 14A is so placed on the ground (horizontal plane H) that a bottom surface 14*b* thereof is in contact therewith and that the golf club has a predetermined lie angle γ and a predetermined loft angle δ.

More specifically, there are provided a set of iron clubs having the following constructions (1) and (2): In the construction (1), in an iron club of a lowest number or in the iron club of the lowest number and several iron clubs of a low-number side succeeding the iron club of the lowest number, the specified plane intersects with the plane including the principal elastic axis and the principal geometrical axis at an intersection angle of 45°–90°. When the specified plane is divided into a club head front face-side space and club head rear face-side space, the principal elastic is positioned in the club head rear face-side space. Construction (2): In an iron club of a highest number or in the iron club of the highest number and several iron clubs of a high-number side succeeding the iron club of the highest number, the specified plane intersects with the plane including the principal elastic axis and the principal geometrical axis at an intersection angle of 45°–90°. When the specified plane is divided into a club head front face-side space and club head rear face-side space, the principal elastic is positioned in the club head rear face-side space. In addition, it is possible to adopt both the constructions (1) and (2).

More specifically, there is provided a set of iron clubs, wherein the iron club of the lowest number and several iron clubs of the low-number side succeeding the iron club of the lowest number are at least two iron clubs selected from iron clubs having a loft angle less than 26°, and the iron club of the highest number and several iron clubs of the high number side succeeding the iron club of the highest number are at least two iron clubs selected from iron clubs having a loft angle more than 36°.

In the use of a set of iron clubs having the construction, when the principal elastic axis of the shaft of the iron club of the low-number side and the high-number side deviates from the principal geometrical axis of the shaft thereof, with the predetermined intersection angle formed therebetween, the shaft is deflected and twisted owing to the toe-down caused by a centrifugal force generated by the swing. Therefore, in the head of the club of the low-number side in which the principal elastic axis of the shaft is positioned in the head rear face-side space, even though the golfer swings by turning the body forward earlier than the appropriate timing, the deflection and the twist of the shaft causes the orbit of the iron club to be so corrected that the front face of the club head is oriented appropriately to a golf ball. Otherwise, the tow side of the club head lags behind the heel side thereof in the arrival thereof at the hitting position. On the other hand, in the club of the high-number side head in which the principal elastic axis of the shaft is positioned in the head front face-side space, even though the golfer swings by turning the wrists forward earlier than the appropriate timing, the deflection and the twist of the shaft causes the orbit of the iron club to be so corrected that the front face of the club head is oriented appropriately to a golf ball. Otherwise, the heel side of the club head lags behind the toe side thereof in the arrival thereof at the hitting position. Therefore, the player is allowed to merely so swing the iron club downward to the golf ball that the front face of the club head is oriented appropriately to a golf ball, thus being capable of flying the golf ball straight to a target point comparatively easily, without the need of swinging the iron clubs in different forms regardless of whether the player uses the iron club of the low-number side or the iron club of the high-number side, although there is a difference between the length of the shaft of the iron club of the low-number side and that of the shaft of the iron club of the high-number side.

As described above, according to the present invention, it is possible to so construct the iron club of the high-number side of a set of iron clubs that it is not deflected or twisted when it is swung and so construct the iron club of the low-number side that it is deflected or twisted when it is swung. On the other hand, it is possible to so construct the iron club of the high-number side of a set of iron clubs that it is deflected or twisted when it is swung and so construct the iron club of the low-number side that it is not deflected or twisted when it is swung. This construction has been devised in consideration of the fact that some golfers so swing the iron club of the low-number side that they hardly misshot and some players so swing the iron club of the high-number side that they hardly misshot.

The loft angle of the iron clubs of the low-number side which are deflected and twisted when the player swings is set to less than 26°, and the loft angle of the iron clubs of the high-number side which are deflected and twisted when the player swings is set to more than 36°. This is because in swinging the iron clubs of the low-number side (iron clubs lower than fifth iron), having the loft angle less than 26° the player is liable to turn the body earlier than the wrist, and in swinging the iron clubs of the high-number side (iron clubs higher than eighth iron) having the loft angle more than 36°, the player is liable to turn the wrist earlier than the body.

It is preferable that there is provided a set of iron clubs in which in the iron club of the lowest number and the several iron clubs of the low-number side succeeding the iron club of the lowest number in which the specified plane intersects with the plane including the principal elastic axis and the principal geometrical axis at the intersection angle of 45°–90°, the intersection angle between the specified plane and the plane including the principal elastic axis and the principal geometrical axis becomes increasingly great as the loft angle becomes smaller. In the iron club of the highest number and the several iron clubs of the high number side in which the specified plane intersects with the plane including the principal elastic axis and the principal geometrical axis at the intersection angle of 45°–90°, the intersection angle between the specified plane and the plane including the principal elastic axis and the principal geometrical axis becomes increasingly great as the loft angle becomes greater. This construction has been devised for the following reason: As the number of the golf club becomes lower, the degree of the delay in the arrival of the toe side of the club head thereof becomes increasingly great with respect to the arrival of the heel side thereof. Thus, as the number of the golf club becomes lower, the correction amount of the orbit thereof is set to be greater owing to the deflection and twist of the shaft.

There is provided a golf club having a club head installed on a leading end of a golf club shaft in which at least one portion is formed an anisotropic material. When the golf club is placed in a space by fixing a region having a length of 150 mm of the golf club shaft and positioned at a grip side of the golf club shaft such that an axis (M) of the golf club shaft is parallel with a ground surface and that a normal line to a center of a front face of the club head is parallel with the ground surface, a straight line L1' formed by projecting a normal line L1 to the center of the front face of the club head on a plane (Q) perpendicular to the axis (M) of the golf club shaft intersects at an intersection angle ($\theta_1$) in a range of $0° < \theta_1 \leqq 3.5°$ with a straight line L2' formed by projecting a normal line L2 to the center of the front face of the club head on the plane (Q) perpendicular to the axis (M) of the golf club shaft when a load of 1.1 kg is applied to the golf club shaft vertically downwardly at a position (P) thereof which is spaced by 98% of the entire length (N) of the golf club with respect to the end of the grip side of the golf club shaft, with the golf club placed in a condition similar to the condition.

In the golf club of the present invention, a pseudo twisted state of the shaft is made owing to the toe-down of the club head caused by a centrifugal force generated by the swing of the golf club, and an appropriate range of the twist angle of the shaft is specified to correct the orbit of the golf club so that the front face of the club head is oriented appropriately to the golf ball.

When the golf club is placed in a space in parallel with the surface of the ground with the end of the golf club shaft at the grip side thereof fixed, the axis of the shaft is deflected to some extent by the weight of the club head. Thus, the axis of the shaft is not straight but curved. As shown in FIG. 5, a line 54 connecting a shaft center point (T) of an end 50A of the shaft 50 at the grip portion side thereof with a shaft center point T' at an end 53*a* of a ferrule 53 of the club head 52 at the grip portion 51 side thereof is set as the axis (M) of the shaft.

FIG. 6 shows the relationship among the axis (M) of the shaft, normal lines L1 and L2 to the front face of the club head at the center thereof, a plane (Q) perpendicular to the axis (M) of the shaft, a straight line L1' formed by projecting the normal line L1 to the front face at the center thereof on the plane (Q), the entire length (N) of the golf club, a position (P) of the shaft whose length is 98% of the entire length (N) of the golf club from the end of the grip side of the shaft, a straight line L2' formed by projecting the normal line L2 to the front face at the center thereof on the plane (Q), and an intersection angle ($\theta_1$) formed between the straight lines and L1' and L2'. FIG. 6A shows the twist of the shaft of the golf club which corrects the hooker's orbit in swinging the golf club. FIG. 6B shows the twist of the shaft of the golf club which corrects the slicer's orbit in swinging the golf club.

When the golf club having the construction is used, the shaft is deflected and twisted owing to the toe-down caused by a centrifugal force generated by the swing. In the golf club whose shaft is formed of the anisotropic material so that the shaft is twisted toward the head face side (front side of head) as shown in FIG. 6B, the deflection and the twist of the shaft causes the orbit of the iron club swung by the slicer to be so corrected that the front face of the club head is oriented appropriately to the golf ball. Otherwise, the tow side of the club head lags behind the heel side thereof in the arrival thereof at the hitting position. In the golf club whose shaft is formed of the anisotropic material so that the shaft is twisted toward the side opposite to the head face side (front side of head) as shown in FIG. 6A, the deflection and the twist of the shaft causes the orbit of the iron club swung by the hooker to be so corrected that the front face of the club head is oriented appropriately to a golf ball. Otherwise, the heel side of the club head lags behind the toe side thereof in the arrival thereof at the hitting position. Accordingly, at the time of impact of the club head, the slicer and the hooker can so hit the golf ball that the front face of the club head is directed to substantially the aimed direction (direction in which the golf ball should fly) without the slicer and the hooker being conscious of the correction of their singing form. That is, the slicer and the hooker can hit the golf ball straight.

If the intersection angle ($\theta_1$) which is formed between the straight lines L1' and L2' is greater than 3.5°, the correction action is so strong that a player feels uncomfortable or many golf balls curve in the direction opposite to the direction in which the golf ball hit by the slicer or the hooker fly. Thus, the intersection angle ($\theta_1$) is set to $0° < \theta_1 \leqq 3.5°$. In this range, the swinging orbit (orientation of front face) can be corrected with high accuracy even in the case of the slicer or the hooker of low-grade and middle-grade. If the intersection angle ($\theta_1$) is too small in this range, the degree of the correction effect is low, whereas if the intersection angle ($\theta_1$) is too large, the above-described unfavorable tendency can be outstandingly exhibited. Thus, it is more favorable that the intersection angle ($\theta_1$) is in a range of $0.8° \leqq \theta_1 \leqq 3.3°$.

It is preferable that the golf club shaft is formed partially of an anisotropic material consisting of at least one of fiber reinforced resin, fiber reinforced rubber, and orientative rubber or a plurality thereof combined with each other such that a part of a fibrous angle of the anisotropic material and/or an orientation angle thereof is differentiated from other portions thereof partly in the circumferential direction of the golf club shaft and in at least one portion in a thickness direction thereof. When a plane parallel with an intersection line formed by the intersection of a front face of the club head and a horizontal plane and including a principal geometrical axis of the golf club shaft is set as a specified plane, with a golf club placed in a predetermined state on the horizontal plane, the club head is so installed on the golf club shaft that the principal elastic axis of the golf club shaft intersects with a plane including the principal elastic axis and the principal geometrical axis at an intersection angle greater than (0° ), with a region of 150 mm of the golf club shaft with respect to an end at a grip side thereof fixed. As the intersection angle ($\theta_2$) becomes smaller, a higher degree of anisotropy is required for the shaft to set the intersection angle ($\theta_1$) formed between the straight lines L1' and L2' to $0° < \theta_1 \leqq 3.5°$. Thus, the intersection angle ($\theta_2$) is set to favorably 10°–90° and more favorably 80°–90°. That the golf club is placed on the horizontal plane in a predetermined state means the state as shown in FIGS. 1 through 4.

In the fiber reinforced resin which is used for the shaft of the resent invention, a reinforcing fiber material such as glass fiber, carbon fiber, various organic fibers, alumina fiber, silicon carbide fiber, metal fiber and/or mixtures of these fibers, woven cloth or mat can be preferably used as the reinforced fiber, and resin such as polyamide, epoxy or polyester can be preferably used.

The shaft may be entirely formed of the fiber reinforced resin. In addition, an anisotropic material such as fiber reinforced rubber and orientative rubber and/or resin or rubber not containing fiber may be used in combination with the fiber reinforced resin.

The construction of the shaft made of the above-described material may be the same through the entire length thereof or may be altered axially.

BRIEF DESCRIPTION OF THE DRAWINGS

FIG. 39A is a schematic view showing the orientation of the face of a head at the time of impact in the case of a slicer; FIG. 39B is a schematic view showing the orientation of the face of a head at the time of impact in the case of a hooker;

DESCRIPTION OF THE PREFERRED EMBODIMENTS

The embodiments of the present invention will be described below.

First Embodiment

In the description which will be made below, for the convenience of the description, a columnar coordinate (r, θ, Z) whose Z-axis consists of a principal geometrical axis (G) of a golf club shaft (hereinafter referred to as merely shaft) is set.

FIGS. 7 through 14 show a shaft 12 of the first embodiment. The shaft 12 consisting of FRP (carbon fiber reinforced epoxy composite material) is manufactured by using a method of laminating prepreg sheets cut to a predetermined size, as will be described later.

Figure 12:
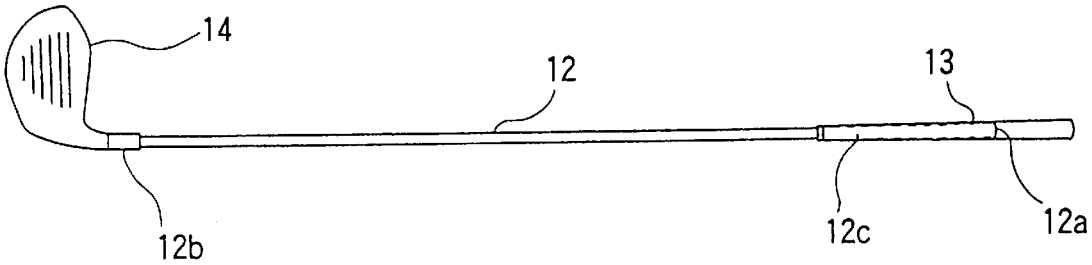
FIG. 12 is a schematic view showing a state in which a club head and a grip have been installed on the golf club shaft shown in FIG. 7.

The entire length (L) of the shaft 12 is 1200 mm. Describing a grip-mounting portion 12*c* of the shaft 12, the outer diameter $OD_1$ and the inner diameter $ID_1$ at one end 12*a* thereof on which a grip 13 shown in FIG. 12 is to be mounted is set to 15.6 mm and 12.6 mm, respectively; and the outer diameter $OD_1$ and the inner diameter $ID_1$ of the grip-mounting portion 12*c* are set to the same length, respectively in the region of $l_1$=200 mm from one end 12*a* thereof to the other end thereof. The region from one end of the grip-mounting portion 12*c* to the other end 12*b* of the shaft 12 on which a club head (hereinafter referred to as merely head) 14 shown in FIG. 12 is to be mounted has a length $l_2$=1000 mm and is tapered to the end 12*b*. The outer diameter $OD_2$ of the shaft $l_2$ and the inner diameter $ID_2$ thereof at the other end 12*b* are set to 7.5 mm and 4.5 mm, respectively.

Figure 13:
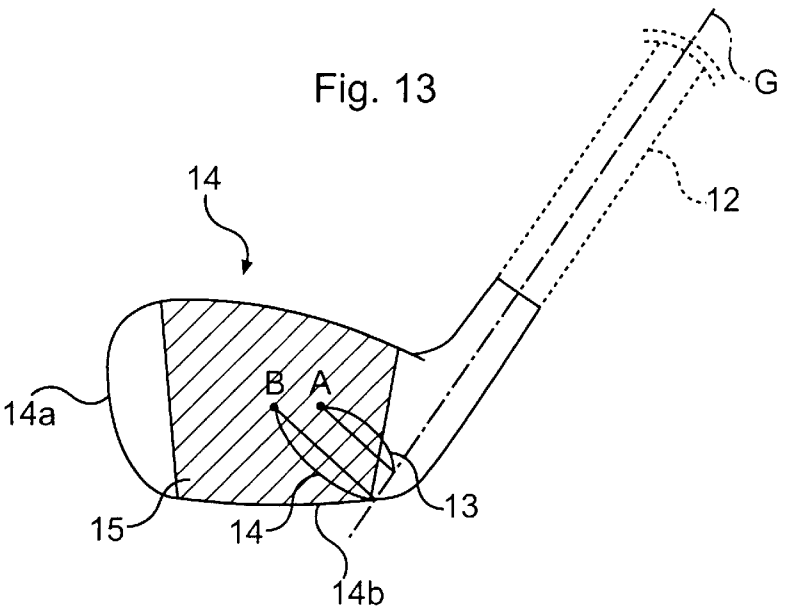
FIG. 13 is a plan view showing the front face of the club head shown in FIG. 7.

As shown in FIGS. 12 and 13, the grip 13 is fixedly mounted on the periphery of the grip-mounting portion 12*c* positioned at one side of the shaft 12. A wood type head 14 made of stainless steel is mounted on the other end of the shaft 12.

The center (A) of gravity of the weight of the head 14 is spaced at $l_3$=34 mm from the principal geometrical axis (G) of the shaft 12. The position of the center (A) of gravity of the head 14 is determined according to the shape thereof and the weight distribution thereof. The distance of $l_3$ of the head 14 commercially available is in the range of 20 mm–60 mm.

Referring to FIG. 13, a scoring area 15 of a front face 14*a* of the head 14 shown by oblique lines is approximately trapezoidal. The geometrical center (B) of gravity of the scoring area 15 is spaced at $l_4$=37 mm from the principal geometrical axis (G), supposing that the head 14 has been mounted on the shaft 12. The position of the geometrical center (B) of gravity is determined according to the shape of the scoring area 15 (see FIG. 13).

Figure 1:
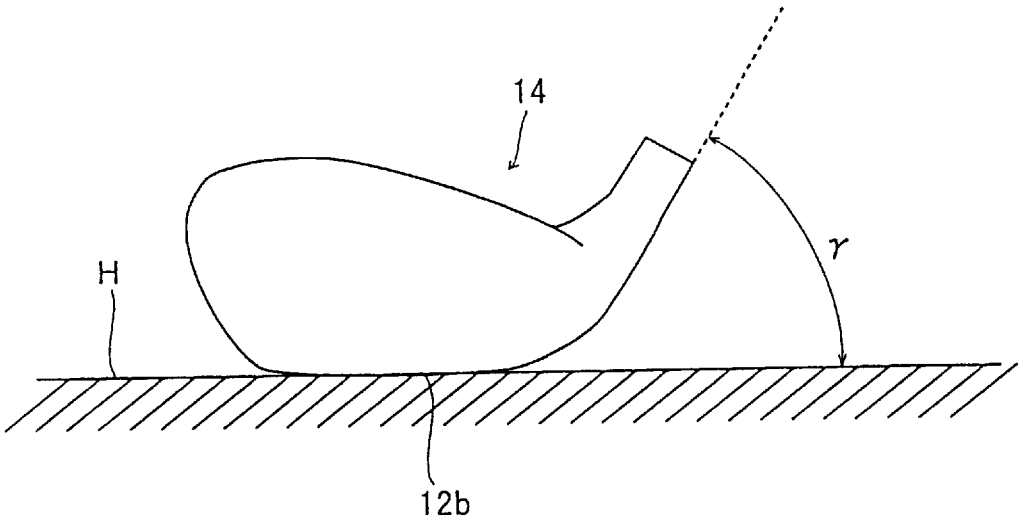
FIG. 1 is a front view explaining the lie angle of a wood club head.
Figure 2:
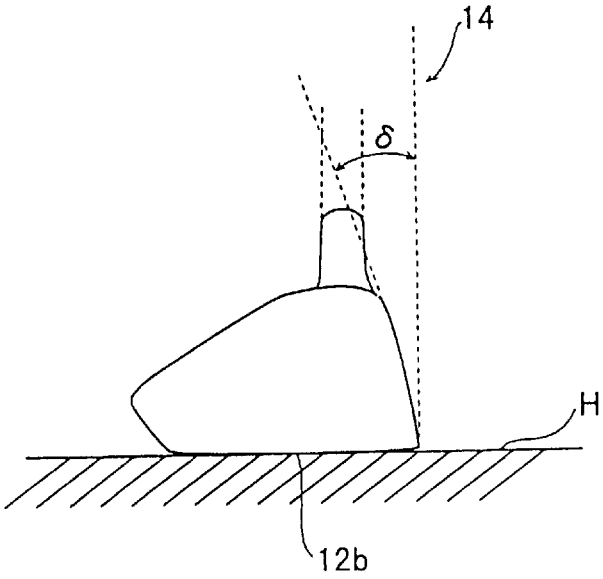
FIG. 2 is a side view explaining the loft angle of the wood club head.
Figure 3:
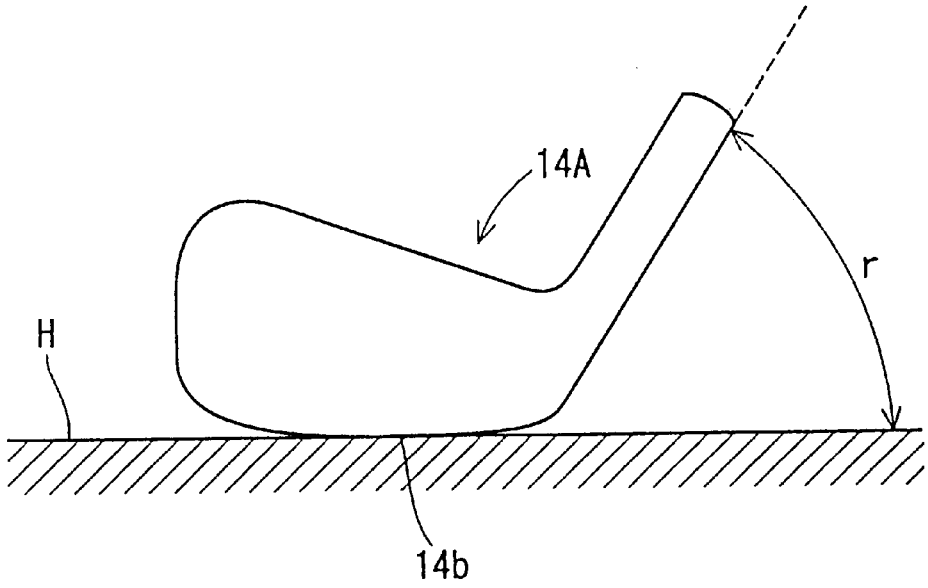
FIG. 3 is a front view explaining the lie angle of an iron club head.
Figure 4:
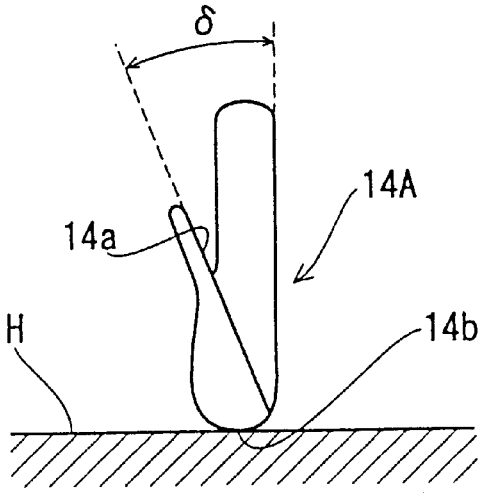
FIG. 4 is a side view explaining the loft angle of the iron club head.
Figure 5:
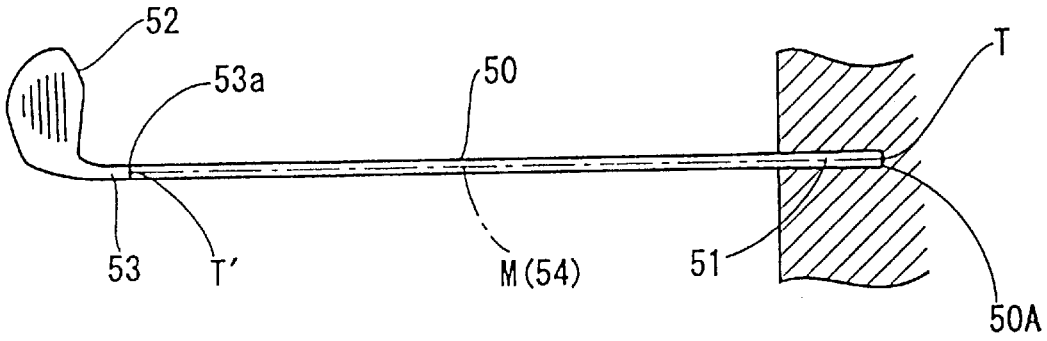
FIG. 5 is an explanatory view explaining the definition of the axis of a shaft of a golf club of the present invention.
Figure 14:
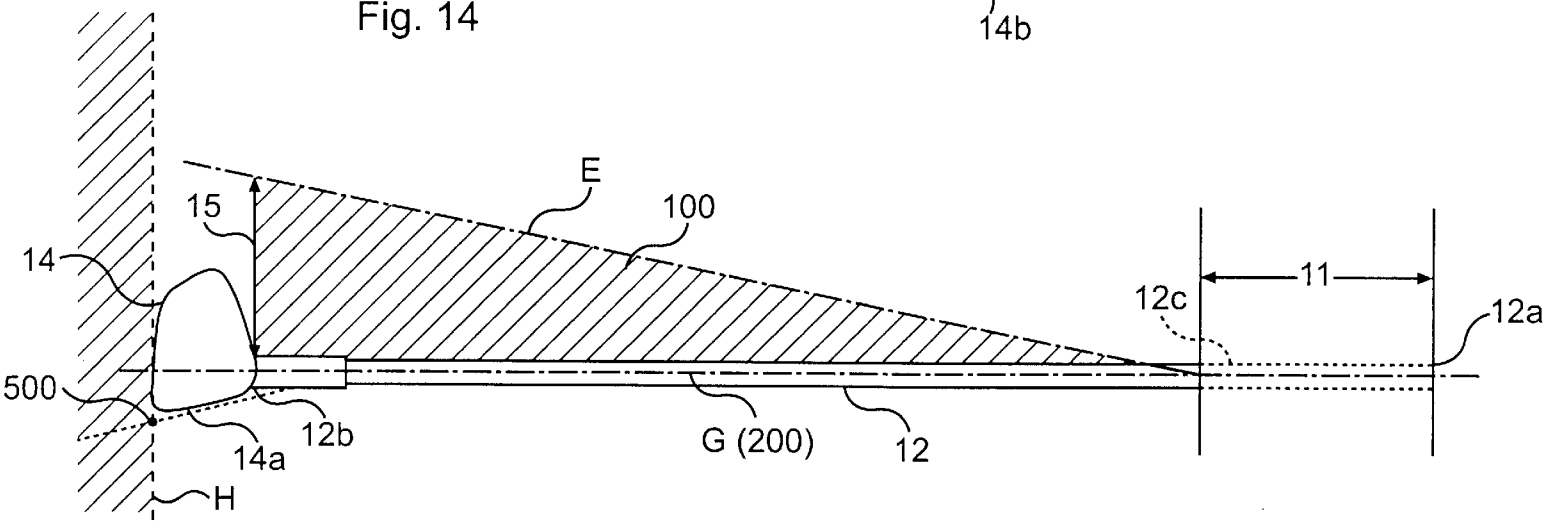
FIG. 14 is a plan view showing a state in which one end of the golf club shaft shown in FIG. 7 has been fixed.

The club assembled from the shaft 12 and the head 14 installed thereon is placed on the horizontal plane in the predetermined state (state shown in FIGS. 1 and 2). As shown in FIG. 14, when a plane 200, parallel with an intersection line 500 formed by the intersection of a front face 14*a* of the head 14 and the horizontal plane H and including the principal geometrical axis G of the shaft 12 is set as a specified plane 200, the principal elastic axis E of the shaft 12 is so positioned that a plane 100 including the principal elastic axis E and the principal geometrical axis G intersect with the specified plane 200 at an intersection angle of 90°, with a region 11 of 200 mm of the shaft 12 with respect to an end 12*a* at a grip side thereof fixed; and a portion of the shaft 12 is differentiated from other portion thereof in the material quality, the fibrous angle, and the fibrous angle so that the principal elastic axis (E) of the shaft 12 is positioned in a head rear face-side space, with the specified plane 200 set as the boundary between the head rear face-side space and a head front face-side space. In other words, in viewing FIG. 14, H is the horizontal plane which extends into and out of the page; 500 is an end view of a line extending into and out of the page which lies in the plane H along the edge of the front face 14*a*; 200 is an end view of the specified plane extending into and out of the page and being parallel to the line 500; and E is a side view of the principal elastic axis. The principal elastic axis starts at a point on the principal geometric axis G displaced 200 mm from an end 12*a* of the shaft 12 and proceeds through a point displaced a distance 15 from the principal axis G. The principal elastic axis E is also positioned so that a plane 100 containing the principal elastic axis E and the principal geometrical axis G intersects the specified plane 200 at a 90° angle.

Figure 9:
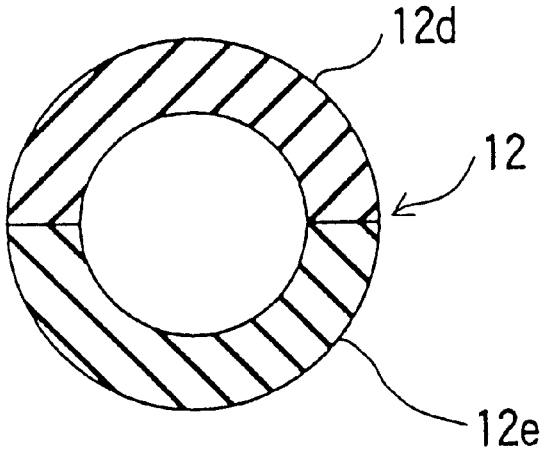
FIG. 9 is a sectional view showing the golf club shaft shown in FIG. 7.
Figure 10:
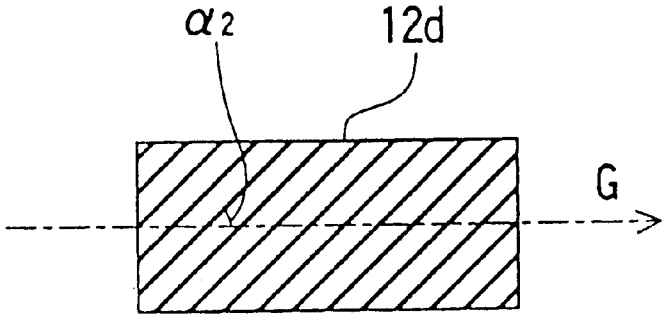
FIG. 10 is a schematic view showing the fibrous angle of the golf club shaft shown in FIG. 7.
Figure 11:
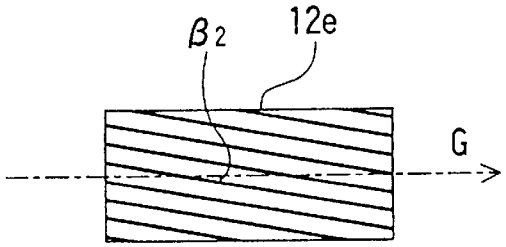
FIG. 11 is a schematic view showing the fibrous angle of the golf club shaft shown in FIG. 7.

That is, irrespective of the value of Z-axis, the fibrous angle $\alpha_2$ is set to $\alpha_2$=6° in a region 12*d* of $0° \leqq \theta < 180°$, whereas the fibrous angle $\beta_2$ is set to $\beta_2$=−6° in a region 12*e* of $180° \leqq \theta < 360°$. Each of the regions 12*d* and 12*e* consists of 12 prepreg sheets laminated one upon another (FIGS. 9 through 11).

The shaft 12 is manufactured as follows: First, prepreg sheets each having a semicircumference obtained by so cutting a material sheet that the fibrous angle is $\alpha_2$ are prepared. Prepreg sheets each having a semicircumference obtained by so cutting a material sheet that the fibrous angle is $\beta_2$ are prepared. The prepreg sheets are laminated one upon another on the regions 12*d* and 12*e* of a mandrel. Then, the prepreg sheets are pressurized, with a wrapping tape spirally wound on the uppermost prepreg sheet of each region 12*d* and 12*e*. Then, prepreg sheets are cured in an oven.

Figure 7:
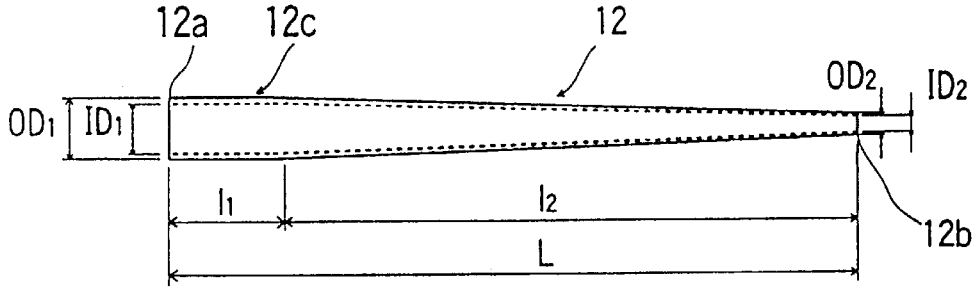
FIG. 7 is a plan view showing an example of the golf club shaft of the present invention.
Figure 8:
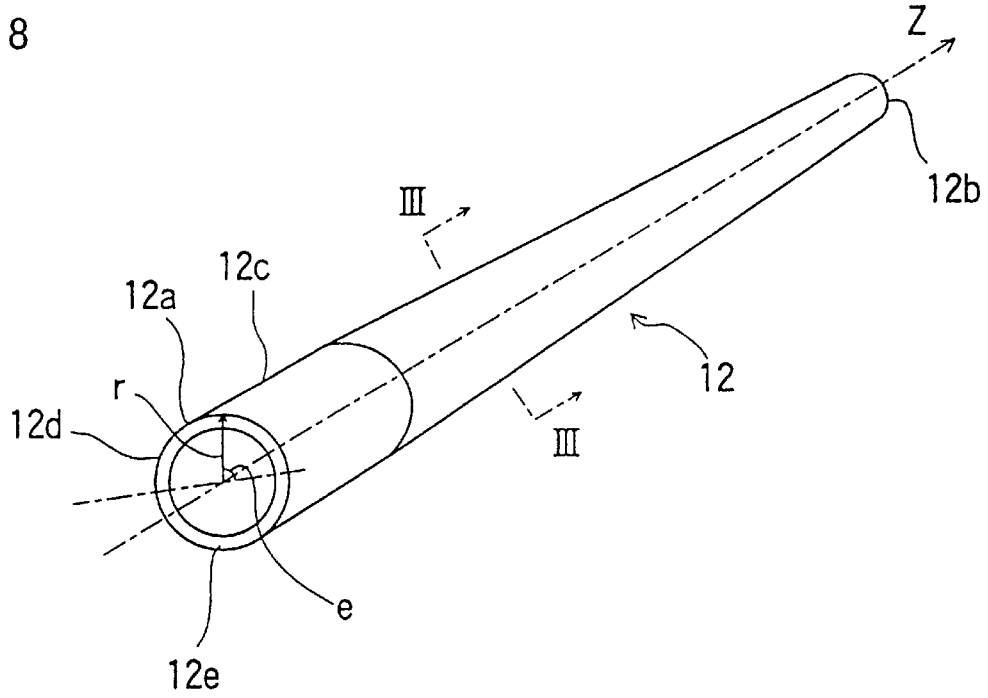
FIG. 8 is a perspective view showing the golf club shaft shown in FIG. 7.

Referring to FIGS. 7 and 14, the shaft 12 is held as a cantilever having the length of $l_2$=1000 mm, with the grip-mounting portion 12*c* fixed and the region $l_1$=200 mm ranging from one end 12*a* thereof to the other end thereof set as a fixed end. In this state, a plane 100 including the principal elastic axis (E) and the principal geometrical axis (G) is parallel with an intersection line formed by the intersection of a front face 14*a* of the head 14 and a horizontal plane and is perpendicular to a plane 200 including the principal geometrical axis (G) of the shaft 12; and the principal elastic axis (E) deviates from the principal geometrical axis (G) by $l_5$=35.7 mm at the other end 12*b*, or the leading end of the shaft 12.

In the deflection of the shaft 12 in the vicinity of an impact time of the head 14 on a golf ball, although the components acting perpendicular to the specified plane are different from one another in direction depending on golfers, the absolute value thereof is small. On the other hand, in the component acting in the specified plane, the center of gravity of the head 14 is positioned at the toe side with respect to the axis of the shaft 12. Thus, irrespective of players, the shaft 12 flexes toward the heel of the head 14. In particular, in the vicinity of the impact point at which the head speed is high, the absolute value of the component acting in the specified plane is considerably great. Measuring the degree of the deflection of the shaft 12 when the shaft 12 was subjected to the component acting perpendicular to the specified plane and the degree of the deflection thereof when the shaft 12 was subjected to the component acting in the specified plane, the degree of the deflection of the latter was mostly three to seven times as great as that of the former. In some cases, the degree of the deflection of the latter was more than seven times as great as that of the former.

In the shaft 12, the plane 100 including the principal elastic axis (E) and the principal geometrical axis (G) is so set that it is parallel with the intersection line formed by the intersection of the front face 14*a* of the head 14 and the horizontal plane and is perpendicular to the plane (specified plane) 200 including the principal geometrical axis (G) of the shaft 12. Thus, the shaft 12 is twisted when it is subjected to the deflection acting in the front face of the head 14 owing to a toe-down caused by a centrifugal force during the swinging of the club.

Eight shafts were prepared to assemble eight clubs therefrom to measure the twist of each shaft when each club is swung. Of the eight shafts, the number of prepreg sheets which were laminated one upon another, the fibrous direction thereof, the material of six shafts were different from those of the shaft 12. In the seven shafts (including the shaft 12), the principal elastic axis (E) and the principal geometrical axis (G) thereof deviated from each other, and the plane including the principal elastic axis (E) and the principal geometrical axis (G) intersect with the specified plane at 45°, 80°, and 90°. In one shaft, the principal elastic axis (E) and the principal geometrical axis (G) thereof were coincident with each other.

Table 1 shows the lamination construction of the eight shafts.

TABLE 1

| | Lamination Construction (Orientation Angle of Fiber, Number of Layers) | | | | |
|---|---|---|---|---|---|
| | | Position in Circumferential Direction | | | |
| | | 0° ≦ θ < 180° | | 180° ≦ θ < 360° | |
| Comparative Example | inner side | 45° | | 45° | |
| | ↓ | −45° | 3 layers | −45° | 3 layers |
| | outer side | 0° | 6 layers | 0 | 6 layers |
| Example 1 | | 6° | 12 layers | −6° | 12 layers |
| Example 2 | inner side | 0° | 4 layers | 0° | 4 layers |
| | outer side | 50° | 8 layers | −50 | 8 layers |
| Example 3 | inner side | 35° | | 35° | |
| | ↓ | −35° | 5 layers | −35° | 5 layers |
| | outer side | 15° | 2 layers | −15° | 2 layers |
| Example 4 | inner side | 0° | 4 layers | 0° | 4 layers |
| | outer side | 45° | 8 layers | −45° | 8 layers |
| Example 5 | inner side | 45° | | 45° | |
| | ↓ | −45° | 3 layers | −45° | 3 layers |
| | | 0° | 4 layers | 0° | 4 layers |
| | outer side | 30° | 2 layers | −30° | 2 layers |
| Example 6 | inner side | 45° | | 45° | |
| | ↓ | −45° | 3 layers | −45° | 3 layers |
| | | 0° | 4 layers | 0° | 4 layers |
| | outer side | 38° | 2 layers | −38° | 2 layers |
| Example 7 | inner side | 45° | | 45° | |
| | ↓ | −45° | 3 layers | −45° | 3 layers |
| | | 0° | 3 layers | 0° | 3 layers |
| | outer side | 25° | 3 layers | −25° | 3 layers |

EXAMPLE 1

The twist of the shaft 12 was examined. 12 layers of prepreg sheets having a semicircumference were laminated one upon another in a region of 0°≦θ<180° in the circumferential direction of the shaft 12. The fibrous orientation angle of the prepreg sheets with respect to the principal geometrical axis of the shaft 12 was 6°. 12 layers of prepreg sheets having a semicircumference were laminated one upon another in a region of 180°≦θ<360° in the circumferential direction of the shaft 12. The fibrous orientation angle of the prepreg sheets with respect to the principal geometrical axis of the shaft 12 was −6°. The fibrous angles of the 12 prepreg sheets were equal to each other in the thickness direction (r-direction) thereof.

EXAMPLE 2

In the region of 0°≦θ<180° in the circumferential direction of the shaft of the example 2, four layers of prepreg sheets each having a semicircumference and a fibrous orientation angle of 0° were laminated one upon another at the inner peripheral side thereof, and eight layers of prepreg sheets each having a semicircumference and a fibrous orientation angle of 50° were laminated one upon another at the peripheral side thereof. In the region of 180°≦θ<360° in the circumferential direction of the shaft, four layers of prepreg sheets having a semicircumference and a fibrous orientation angle of 0° were laminated one upon another at the inner peripheral side thereof, and eight layers of prepreg sheets each having a semicircumference and a fibrous orientation angle of −50° were laminated one upon another at the peripheral side thereof.

EXAMPLE 3

In the region of 0°≦θ<180° in the circumferential direction of the shaft of the example 3, four layers of prepreg sheets each having a semicircumference and fibrous orientation angles of 35° and −35° were laminated one upon another at the inner peripheral side thereof, and two layers of prepreg sheets each having a semicircumference and a fibrous orientation angle of 15° were laminated one upon another at the peripheral side thereof. In the region of 180°≦θ<360° in the circumferential direction of the shaft, four layers of prepreg sheets each having a semicircumference and fibrous orientation angles of 35° and −35° were laminated one upon another at the inner peripheral side thereof, and two layers of prepreg sheets each having a semicircumference and a fibrous orientation angle of −15° were laminated one upon another at the peripheral side thereof.

EXAMPLE 4

In the region of 0°≦θ<180° in the circumferential direction of the shaft of the example 4, four layers of prepreg sheets each having a semicircumference and a fibrous orientation angle of 0° were laminated one upon another at the inner peripheral side thereof, and eight layers of prepreg sheets each having a semicircumference and a fibrous orientation angle of 45° were laminated one upon another at the peripheral side thereof. In the region of 180°≦θ<360° in the circumferential direction of the shaft, four layers of prepreg sheets having a semicircumference and a fibrous orientation angle of 0° were laminated one upon another at the inner peripheral side thereof, and eight layers of prepreg sheets each having a semicircumference and a fibrous orientation angle of −45° were laminated one upon another at the peripheral side thereof.

EXAMPLE 5

In the region of 0°≦θ<180° in the circumferential direction of the shaft of the example 5, three layers of prepreg sheets each having a semicircumference and fibrous orientation angles of 45° and −45° were laminated one upon another at the inner peripheral side thereof, four layers of prepreg sheets each having a semicircumference and a fibrous orientation angle of 0° were laminated one upon another at the intermediate part thereof, and two layers of prepreg sheets each having a semicircumference and a fibrous orientation angle of 30° were laminated one upon another at the peripheral side thereof. In the region of 180°≦θ<360° in the circumferential direction of the shaft, three layers of prepreg sheets each having a semicircumference and fibrous orientation angles of 45° and −45° were laminated one upon another at the inner peripheral side thereof, four layers of prepreg sheets each having a semicircumference and a fibrous orientation angle of 0° were laminated one upon another at the intermediate part thereof, and two layers of prepreg sheets each having a semicircumference and a fibrous orientation angle of −30° were laminated one upon another at the peripheral side thereof.

EXAMPLE 6

In the region of 0°≦θ<180° in the circumferential direction of the shaft of the example 6, three layers of prepreg sheets each having a semicircumference and fibrous orientation angles of 45° and −45° were laminated one upon another at the inner peripheral side thereof, four layers of prepreg sheets each having a semicircumference and a fibrous orientation angle of 0° were laminated one upon another at the intermediate part thereof, and two layers of prepreg sheets each having a semicircumference and a fibrous orientation angle of 38° were laminated one upon another at the peripheral side thereof. In the region of 180°≦θ<360° in the circumferential direction of the shaft, three layers of prepreg sheets each having a semicircumference and fibrous orientation angles of 45° and −45° were laminated one upon another at the inner peripheral side thereof, four layers of prepreg sheets each having a semicircumference and a fibrous orientation angle of 0° were laminated one upon another at the intermediate part thereof, and two layers of prepreg sheets each having a semicircumference and a fibrous orientation angle of −38° were laminated one upon another at the peripheral side thereof.

EXAMPLE 7

In the region of $0° \leqq \theta < 180°$ in the circumferential direction of the shaft of the example 7, three layers of prepreg sheets each having a semicircumference and fibrous orientation angles of 45° and −45° were laminated one upon another at the inner peripheral side thereof, three layers of prepreg sheets each having a semicircumference and a fibrous orientation angle of 0° were laminated one upon another at the intermediate part thereof, and three layers of prepreg sheets each having a semicircumference and a fibrous orientation angle of 25° were laminated one upon another at the peripheral side thereof. In the region of $180° \leqq \theta < 360°$ in the circumferential direction of the shaft, three layers of prepreg sheets each having a semicircumference and fibrous orientation angles of 45° and −45° were laminated one upon another at the inner peripheral side thereof, three layers of prepreg sheets each having a semicircumference and a fibrous orientation angle of 0° were laminated one upon another at the intermediate part thereof, and two layers of prepreg sheets each having a semicircumference and a fibrous orientation angle of −25° were laminated one upon another at the peripheral side thereof.

COMPARATIVE EXAMPLE

In the region of $0° \leqq \theta < 180°$ in the circumferential direction of the shaft of the comparative example, three layers of prepreg sheets each having a semicircumference and fibrous orientation angles of 45° and −45° were laminated one upon another at the inner peripheral side thereof, and six layers of prepreg sheets each having a semicircumference and a fibrous orientation angle of 0° were laminated one upon another at the peripheral side thereof. In the region of $180° \leqq \theta < 360°$ in the circumferential direction of the shaft, three layers of prepreg sheets each having a semicircumference and fibrous orientation angles of 45° and −45° were laminated one upon another at the inner peripheral side thereof, and six layers of prepreg sheets each having a semicircumference and a fibrous orientation angle of 0° were laminated one upon another at the peripheral side thereof.

Except that the prepreg sheet positioned in the peripheral side of the fourth example was made of a boron fiber reinforced epoxy composite material, the other prepreg sheets were all made of a carbon fiber reinforced epoxy resin.

Figure 15:
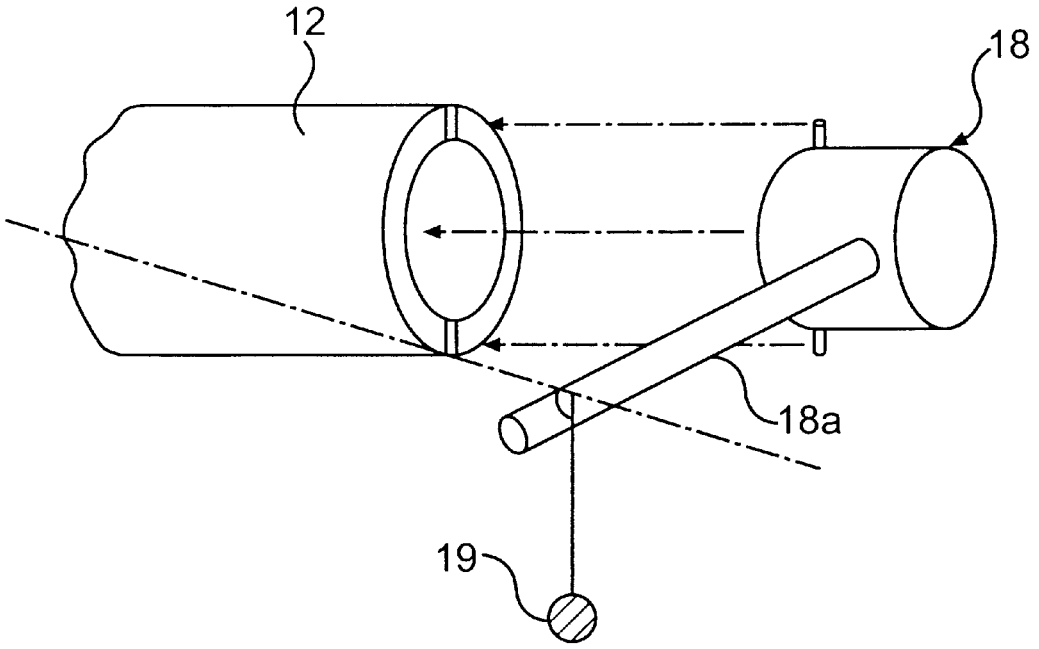
FIG. 15 is a schematic perspective view showing a jig-installing method.
Figure 16:
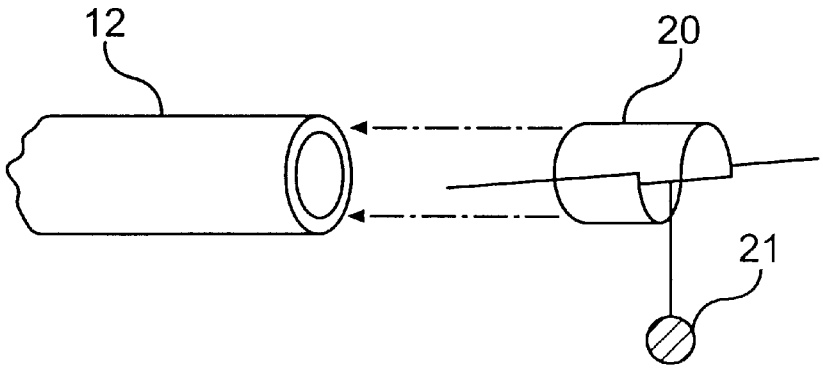
FIG. 16 is a schematic perspective view showing the jig-installing method.

As the experimental method, using a jig (supporting device) 18 shown in FIG. 15 and a jig 20 shown in FIG. 16, a load of 2.0 kg was applied to the leading end side (head-positioned side) of the shaft of each of the first through seventh examples and the comparative example at positions spaced at 0 mm, 20 mm, 30 mm, and 50 mm from the principal geometrical axis (G) thereof, with the region having a length of 200 mm from the grip-positioned side of each of the eight shafts and of the shaft of the comparative example fixed and with the region thereof having a length of 1000 mm projected from the region having the length of 200 mm. Reference numeral 19 and 21 shown in FIGS. 15 and 16, respectively denote weights. Table 2 shows the experimental result.

TABLE 2

| | Load-applied Position (mm) | | | |
|---|---|---|---|---|
| | 0 Deflection (mm) Twist Angle (°) | 20 Deflection (mm) Twist Angle (°) | 30 Deflection (mm) Twist Angle (°) | 50 Deflection (mm) Twist Angle (°) |
| Comparative | 92.6 | 93 | 92.2 | 130 |
| Example 1 | −0.1 | 1.5 | 1.8 | 3.4 |
| Example 1 | 67.3 | 62.2 | 60.7 | 59.6 |
| | −8 | −4 | −1.7 | 3.9 |
| Example 2 | 135.3 | 132.7 | 134.9 | 130.4 |
| | −4.4 | −1.6 | 0.3 | 3 |
| Example 3 | 154.6 | 154 | 152.8 | 154.2 |
| | −1.6 | −0.6 | −0.3 | 1 |
| Example 4 | 128.1 | 125.9 | 124.3 | 124 |
| | −3.5 | −1.8 | −1 | 0.8 |
| Example 5 | 112.7 | 114.2 | 111.9 | 112.3 |
| | −1.7 | −0.4 | −0.1 | 1.3 |
| Example 6 | 120 | 120 | 119.8 | 119.4 |
| | −1.3 | 0 | 0.5 | 1.6 |
| Example 7 | 121.2 | 119.3 | 119.8 | 117.9 |
| | −2.6 | −1.7 | −0.9 | 0 |

Figure 17:
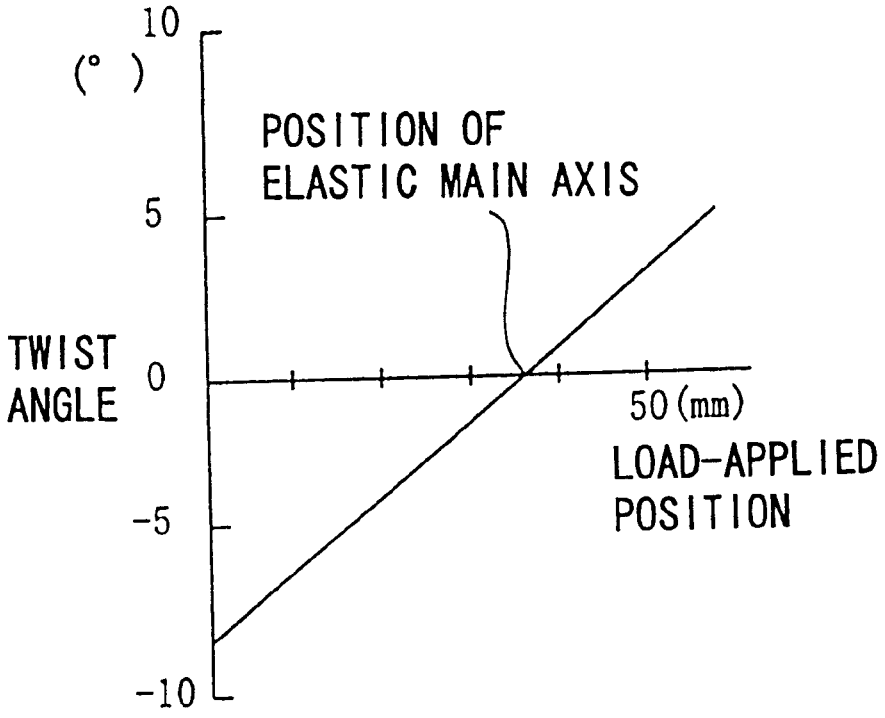
FIG. 17 is a view used to determine the position of a principal elastic axis.

Based on the values shown in table 2, a graph shown in FIG. 17 was drawn on the shaft of the first embodiment. The graph indicates that the position of the principal elastic axis with respect to the leading end (head-positioned side) of the shaft was 35.7 mm. Based on graphs of the shaft of each of the other examples and the comparative example, the position of the principal elastic axis with respect to the leading end thereof was determined. The result is shown in table 3.

TABLE 3

| | Deviation of Principal Elastic Axis (mm) |
|---|---|
| Comparative Example 1 | 0 |
| Example 1 | 35.7 |
| Example 2 | 29.3 |
| Example 3 | 33.7 |
| Example 4 | 41 |
| Example 5 | 28.6 |
| Example 6 | 20.8 |
| Example 7 | 47.2 |

It was confirmed that the position of the principal elastic axis can be set by altering the portion of the shaft in which the material, the fibrous angle, and the fibrous angle are differentiated from other portion thereof.

To conduct tests for measuring the orientation of the front face of the head at an impact time and the deviation of the drop point of the golf ball to the right and left with respect to a target line, a club was assembled from the shaft of each of the first through seventh examples and the comparative example and so mounted on a swinging robot that the front face of the head at an impact time of the front face on the golf ball is reproduced, supposing that the slicer and the hooker hit the golf ball. Table 4 shows the test result.

TABLE 4

| | Direction of Principal Elastic Axis | | Face Direction by Swing Robot | | | Drop Point of Ball with respect to Target Line |
|---|---|---|---|---|---|---|
| | | | Initial Position | | Impact Position | |
| Test Example 1 | 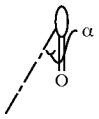 | α = 90° | 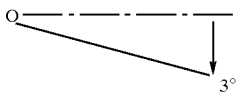 | | 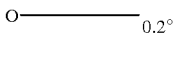 | 2 m to right |
| Test Example 2 | ↑ | α = 90° | 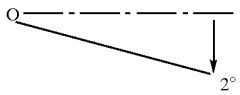 | | 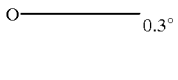 | 2 m to right |
| Test Example 3 | ↑ | α = 90° | 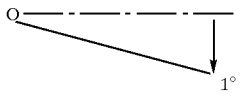 | | 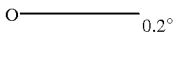 | 1 m to right |
| Test Example 4 | ↑ | α = 90° | ↑ | 1° | 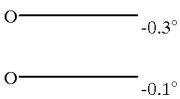 | 4 m to left |
| Test Example 5 | ↑ | α = 90° | ↑ | 1° |  | ±0 m |
| Test Example 6 | ↑ | α = 90° | ↑ | 1° | 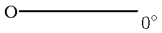 | 1 m to left |
| Test Example 7 | ↑ | α = 90° | ↑ | 1° | 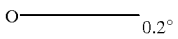 | 1 m to right |
| Test Example 8 | α = 90° (−90°) | 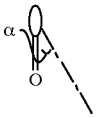 | 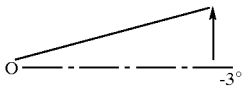 | | 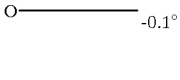 | ±0 m |
| Test Example 9 | α = 90° (−90°) | ↑ | 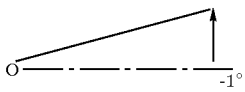 | | 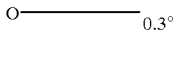 | 1 m to right |
| Test Comparative Example | Coincident with Principal Geometrical Axis | | 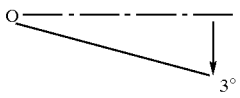 | | 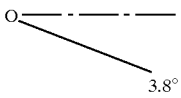 | 28 m to right |
| Test Example 10 | 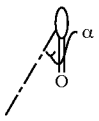 | α = 80° | 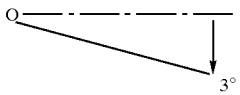 | | 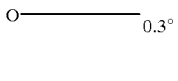 | 4 m to right |
| Test Example 11 | ↑ | α = 45° | 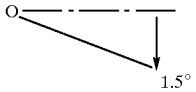 | | 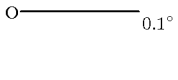 | 1 m to right |

The test samples 1 through 7 shown in table 4 reproduce the case in which iron clubs assembled from the shafts of the examples 1 through 7 were applied to a slicer. In the test, the club was placed on the horizontal plane in a predetermined state. When a plane parallel with an intersection line formed by the intersection of a front face of a head and a horizontal plane and including a principal geometrical axis of the shaft is set as a specified plane, the principal elastic axis of the shaft is so positioned that a plane including the principal elastic axis and the principal geometrical axis intersect with the specified plane at an intersection angle of 90°, with a region of 200 mm of the shaft with respect to an end at a grip side thereof fixed. The principal elastic axis (E) of the shaft is positioned in the head rear face-side space.

The test sample 8 shown in table 4 reproduce the case in which a club assembled from the shaft of the example 8 was applied to a hooker. In the test, the club was placed on the horizontal plane in a predetermined state. When a plane parallel with an intersection line formed by the intersection of a front face of ahead and a horizontal plane and including a principal geometrical axis of the shaft is set as a specified plane, the principal elastic axis of the shaft is so positioned that a plane including the principal elastic axis and the principal geometrical axis intersect with the specified plane at an intersection angle of 90°, with a region of 200 mm of the shaft with respect to an end at a grip side thereof fixed. The principal elastic axis of the shaft is positioned in the head front face-side space. −90° shown in table 4 indicates that the principal elastic axis is positioned at the head front face-side space.

In the test example 9, a test similar to the test example 8 was conducted on the shaft of the example 7.

In the test example 10, a test similar to the test example 1 was conducted on the shaft of the example 1 except that the intersection angle between the plane including the principal elastic axis and the principal geometrical axis of the shaft and the specified plane was altered to 80°.

In the test example 11, a test similar to the test example 1 was conducted on the shaft of the example 1 except that the intersection angle between the plane including the principal elastic axis and the principal geometrical axis of the shaft and the specified plane was altered to 45°.

The comparative test example reproduces the case in which a club assembled from the shaft of the comparative example was applied to a slicer.

It was confirmed from table 4 that the club of the test examples 1 through 7, 10, and 11 can correct a degree of slice and that the club of the test examples 8 and 9 can correct a degree of hook. It was also confirmed that the correction effect becomes increasingly great as the intersection angle between the plane including the principal elastic axis and the principal geometrical axis of the shaft and the specified plane becomes nearer 90°.

Second Embodiment

A plurality of prepreg sheets made of carbon fiber reinforced epoxy resin was prepared. The orientations of the reinforced fibers of the prepreg sheets were different from one another. The prepreg sheets having lamination construction shown in table 5 were wound around a mandrel to prepare four kinds of sample shafts 1 through 4.

TABLE 5

| | Lamination Construction | | | |
|---|---|---|---|---|
| | 0° ≦ θ < 180° | | 180° ≦ θ < 360° | |
| Position in Circumferential Direction | Orientation Angle of Fiber | Number of Layers (Layer) | Orientation Angle of Fiber | Number of Layers (Layer) |
| Sample 1 | +45 | 3 pairs | same as left | |
| | −45 | | | |
| | 0 | 4 | same as left | |
| Sample 2 | +45 | 1 pair | same as left | |
| | −45 | | | |
| | 0 | 5 | same as left | |
| | +35 | 4 | −35 | 4 |
| Sample 3 | +25 | 1 | −25 | 1 |
| | 0 | 5 | same as left | |
| | +25 | 3 | −25 | 3 |
| Sample 4 | +50 | 1 | −50 | 1 |
| | 0 | 5 | same as left | |
| | +50 | 3 | −50 | 3 |

In the sample shaft 1, prepreg sheets each having a semicircumference and wound around a mandrel in a region of 0°≦θ<180° in the circumferential direction of the shaft had the same construction as that of prepreg sheets each having a semicircumference and wound around a mandrel in a region of 180°≦θ<360° in the circumferential direction thereof.

In the sample shaft 2, semicircumferential prepreg sheets which were located at the inner peripheral side and intermediate part of the shaft in the region of 0°≦θ<180° in the circumferential direction thereof had the same construction as that of semicircumferential prepreg sheets which were located at the inner peripheral side and intermediate part of the shaft in the region of 180°≦θ<360° in the circumferential direction thereof. In the peripheral side of the shaft, the reinforced fiber which was located in the region of 0°≦θ<180° in the circumferential direction of the shaft and that which was located in the region of 180°≦θ<360° in the circumferential direction thereof were inclined in opposite direction with respect to the axis of the shaft. That is, the reinforced fiber of semicircumferential four prepreg sheets positioned at the peripheral side of the shaft in the region of 0°≦θ<180° in the circumferential direction of the shaft had an orientation of +35°, whereas the reinforced fiber of semicircumferential four prepreg sheets positioned at the peripheral side of the shaft in the region of 180°≦θ<360° in the circumferential direction thereof had an orientation of −35°.

In the sample shaft 3, semicircumferential prepreg sheets which were located at the intermediate part of the shaft in the region of 0°≦θ<180° in the circumferential direction thereof had the same construction as that of semicircumferential prepreg sheets which were located at the intermediate part of the shaft in the region of 180°≦θ<360° in the circumferential direction thereof. In the peripheral side and the peripheral side of the shaft, the reinforced fiber which was located in the region of 0°≦θ<180° in the circumferential direction of the shaft and that which was located in the region of 180°≦θ<360° in the circumferential direction thereof were inclined in opposite direction with respect to the axis of the shaft. That is, the reinforced fiber of semicircumferential one prepreg sheet positioned at the inner peripheral side of the shaft in the region of 0°≦θ<180° in the circumferential direction of the shaft had an orientation of +25°, whereas the reinforced fiber of semicircumferential one prepreg sheet positioned at the inner peripheral side of the shaft in the region of 180°≦θ<360° in the circumferential direction thereof had an orientation of −25°. The reinforced fiber of semicircumferential three prepreg sheets positioned at the peripheral side of the shaft in the region of 0°≦θ<180° in the circumferential direction of the shaft had an orientation of +25° whereas the reinforced fiber of semicircumferential three prepreg sheets positioned at the peripheral side of the shaft in the region of 180°≦θ<360° in the circumferential direction thereof had an orientation of −25°.

In the sample shaft 4, semicircumferential prepreg sheets which were located at the intermediate part of the shaft in the region of 0°≦θ<180° in the circumferential direction thereof had the same construction as that of semicircumferential prepreg sheets which were located at the intermediate part of the shaft in the region of 180°≦θ<360° in the circumferential direction thereof. In the peripheral side and the peripheral side of the shaft, the reinforced fiber which was located in the region of 0°≦θ<180° in the circumferential direction of the shaft and that which was located in the region of 180°≦θ<360° in the circumferential direction thereof were inclined in opposite direction with respect to the axis of the shaft. That is, the reinforced fiber of semicircumferential one prepreg sheet positioned at the inner peripheral side of the shaft in the region of 0°≦θ<180° in the circumferential direction of the shaft had an orientation of +50°, whereas the reinforced fiber of semicircumferential one prepreg sheet positioned at the inner peripheral side of the shaft in the region of 180°≦θ<360° in the circumferential direction thereof had an orientation of −50°. The reinforced fiber of semicircumferential three prepreg sheets positioned at the peripheral side of the shaft in the region of 0°≦θ<180° in the circumferential direction of the shaft had an orientation of +50°, whereas the reinforced fiber of semicircumferential three prepreg sheets positioned at the peripheral side of the shaft in the region of 180°≦θ<360° in the circumferential direction thereof had an orientation of −50°.

The length of the shaft of each of the samples 1 through 4 was 920 mm.

A test for examining the deformation behavior of each sample shaft was conducted by applying a load thereto in at predetermined direction at a point spaced by 20 mm from an end 100*b* thereof at which the diameter is smallest.

Figure 18:
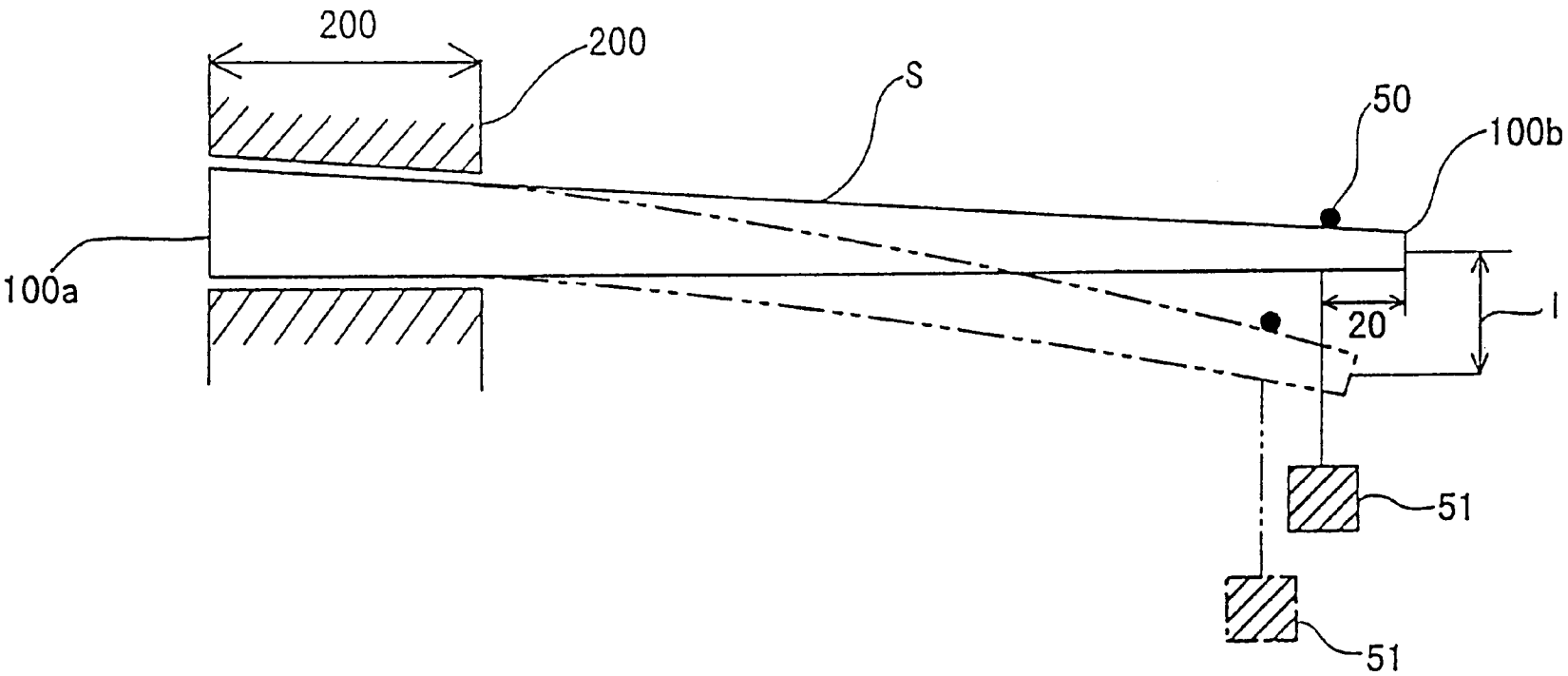
FIGS. 18A and 18B are views showing a method of measuring the deflection amount and twist angle of the golf club shaft.
Figure 18:
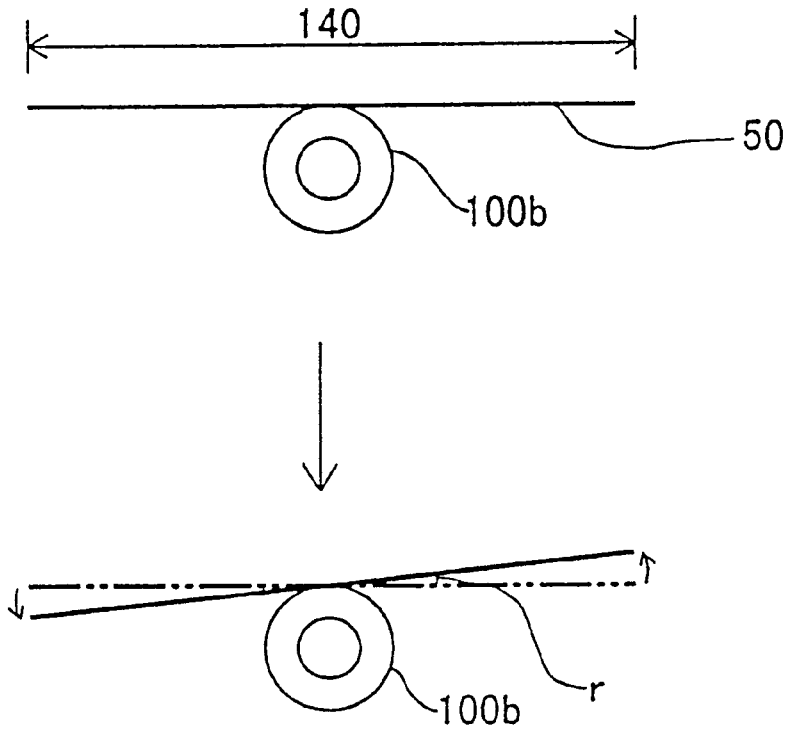
Figure 19:
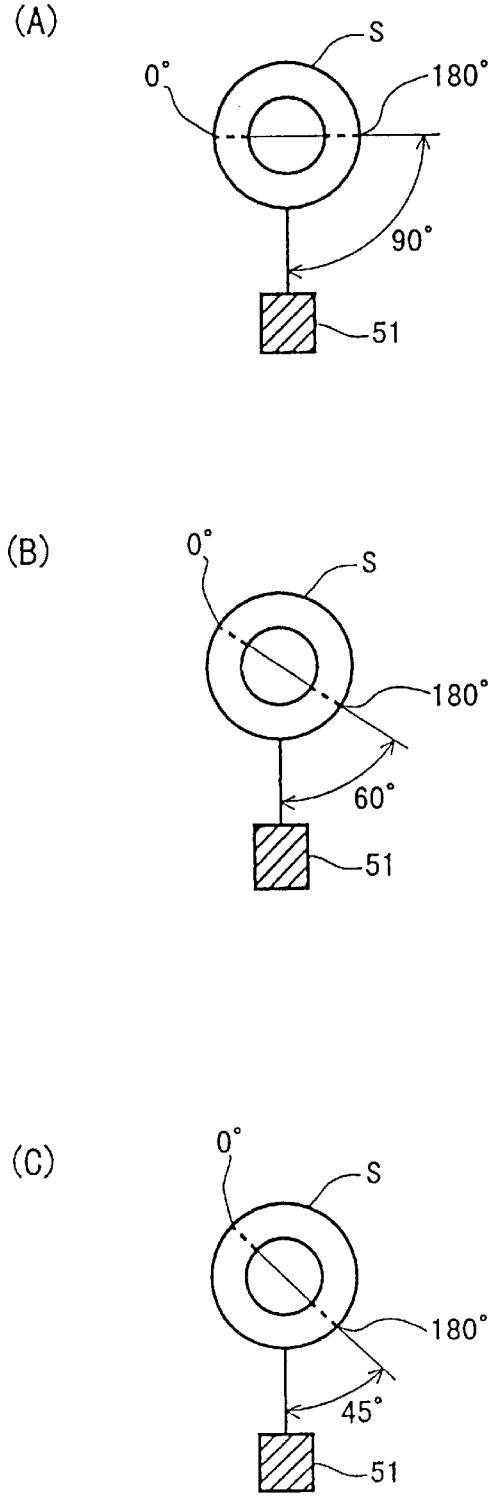
FIGS. 19A, 19B, and 19C are views showing a method of measuring the deflection amount and twist angle of the golf club shaft when a load is applied thereto.

The test was conducted by a method shown in FIG. 18. That is, a shaft (S) was held by a chucking device 200 which chucked a portion thereof having a length of 200 mm from an end 100*a* thereof at which the diameter thereof was largest, with the shaft (S) held horizontally. The center of a metal wire 50 having a length of 140 mm was placed on the upper surface of the shaft (S) at a position thereof which was spaced by 20 mm from the end 100*b* thereof such that the metal wire 50 was horizontal and at a right angle with the axis of the shaft (S). A weight 51 having a weight of 1.1 kg was hung from the shaft (S) at the lower end of the position thereof which was spaced by 20 mm from the end 100*b* of the shaft (S) to measure the deflection amount and twist amount of the shaft (S). As shown in FIGS. 19A through 19C, the shaft-holding orientation was changed to apply the load at 90°, 60°, and 45° with respect to a line connecting the position of 0° and 180° in the circumferential direction of the shaft (S) with each other. As shown in FIG. 18A, the deflection amount of the shaft (S) was determined by measuring the descent amount (1) of the end 100*b* with respect to the position before the load was applied to the shaft (S). As shown in FIG. 18B, the twist amount of the shaft (S) was determined by measuring a rotation angle (γ) of the metal wire 50 with respect to the point of contact between the metal wire 50 and the shaft (S) before the load was applied to the shaft (S). Table 6 shows the test result.

TABLE 6

| | Load-applied Direction (°) | | |
|---|---|---|---|
| | 45<br>Deflection (mm)<br>Twist (°) | 60<br>Deflection (mm)<br>Twist (°) | 90<br>Deflection (mm)<br>Twist (°) |
| Sample 1 | 69.2<br>0.0 | 68.7<br>0.1 | 68.8<br>0.1 |
| Sample 2 | 70.1<br>1.6 | 70.8<br>2.1 | 72.0<br>3.3 |
| Sample 3 | 75.5<br>2.4 | 74.9<br>4.0 | 74.5<br>5.8 |
| Sample 4 | 68.8<br>0.6 | 68.0<br>1.0 | 68.4<br>1.4 |

Table 6 indicates that when the load was laterally applied to the shaft at the point thereof which was spaced by 20 mm from one end thereof, the sample shaft 1 was deflected but not twisted, whereas the sample shafts 2 through 4 were deflected and twisted.

Using the sample shafts 1 through 4, a set of iron clubs of each of examples 1 through 5 and a comparative example was prepared. Table 7 shows which of the sample shafts 1 through 4 was used for a club of each number of each set of iron clubs and the orientation of a head installed on each shaft.

TABLE 7

| | Loft | Comparative Example 1 | | Example 1 | | Example 2 | |
|---|---|---|---|---|---|---|---|
| Club No. | Angle (°) | Kind of Shaft | Orientation of Head (°) | Kind of Shaft | Orientation of Head (°) | Kinf of Shaft | Orientaion of Head (°) |
| 2 | 18 | Sample 1 | 0 | Sample 2 | 90 | Sample 1 | 0 |
| 3 | 20 | Sample 1 | 0 | Sample 1 | 0 | Sample 1 | 0 |
| 4 | 23 | Sample 1 | 0 | Sample 1 | 0 | Sample 1 | 0 |
| 5 | 26 | Sample 1 | 0 | Sample 1 | 0 | Sample 1 | 0 |
| 6 | 29 | Sample 1 | 0 | Sample 1 | 0 | Sample 1 | 0 |
| 7 | 32 | Sample 1 | 0 | Sample 1 | 0 | Sample 1 | 0 |
| 8 | 36 | Sample 1 | 0 | Sample 1 | 0 | Sample 1 | 0 |
| 9 | 40 | Sample 1 | 0 | Sample 1 | 0 | Sample 1 | 0 |
| PW | 45 | Sample 1 | 0 | Sample 1 | 0 | Sample 1 | 0 |
| AW | 51 | Sample 1 | 0 | Sample 1 | 0 | Sample 2 | 90 |
| 2 | 18 | Sample 3 | 90 | Sample 3 | 90 | Sample 3 | 90 |
| 3 | 20 | Sample 3 | 90 | Sample 3 | 60 | Sample 3 | 60 |
| 4 | 23 | Sample 1 | 0 | Sample 3 | 45 | Sample 3 | 45 |
| 5 | 26 | Sample 1 | 0 | Sample 1 | 0 | Sample 3 | 45 |
| 6 | 29 | Sample 1 | 0 | Sample 1 | 0 | Sample 1 | 90 |
| 7 | 32 | Sample 1 | 0 | Sample 1 | 0 | Sample 1 | 90 |
| 8 | 36 | Sample 1 | 0 | Sample 1 | 0 | Sample 4 | 45 |
| 9 | 40 | Sample 1 | 0 | Sample 4 | 45 | Sample 4 | 45 |
| PW | 45 | Sample 4 | 90 | Sample 4 | 60 | Sample 4 | 60 |
| AW | 51 | Sample 4 | 90 | Sample 4 | 90 | Sample 4 | 90 |

The orientation of the head installed on each of the sample shafts 2 through 4 which were deflected and twisted is indicated by an intersection angle between the principal elastic axis of the shaft and the specified plane. When the space in the periphery of the head is divided into a head front face-side space and a head rear face-side space, with the specified plane set as the boundary therebetween, the principal elastic axis of the shaft is positioned in the head rear face-side space in the clubs of the low-number side, whereas the principal elastic axis of the shaft is positioned in the head front face-side space in the clubs of the high-number side.

Because the principal elastic axis and the principal geometrical axis of the shaft are coincident with each other in the sample shaft 1 which is deflected but not twisted, the intersection angle between the principal elastic axis of the shaft and the specified plane is 0° irrespective of the position of the head which is installed on the shaft in the circumferential direction thereof. Thus, the orientation of the head installed on the sample shaft 1 of the club of each number is 0°.

As shown in table 8, in each of a set of iron clubs, the shafts were cut by the predetermined length so that the lengths of the clubs of each number had the standard length: The length of the club is the addition of the length of the shaft and the length of the head.

TABLE 8

| | | | | | | | | | | |
|---|---|---|---|---|---|---|---|---|---|---|
| Length of Shaft (mm) | 974 | 962 | 949 | 936 | 924 | 912 | 900 | 887 | 871 | 871 |
| Length of Club (inch) | 39.5 | 39.0 | 38.5 | 38.0 | 37.5 | 37 | 36.5 | 36 | 35.5 | 35.5 |
| Club No. | 2 | 3 | 4 | 5 | 6 | 7 | 8 | 9 | PW | AW |

Using a set of iron clubs of each of the examples 1 through 5 and the comparative example, the golf ball-hitting test was conducted to measure the distance (deviation amount to the right and left) from the target point to the drop point of each golf ball hit by 10 testers whose skill were in low and high grade. All the testers were right-handed. Four testers were not good at using the long iron, and another four testers were liable to hook golf balls when they use the short iron. Each of the 10 testers hit five golf balls by each club (second iron through approach wedge) of a set of iron clubs of each of the examples 1 through 5 and the comparative example. The average of 50 (10×5) distances was calculated for the club of each number.

Figure 20:
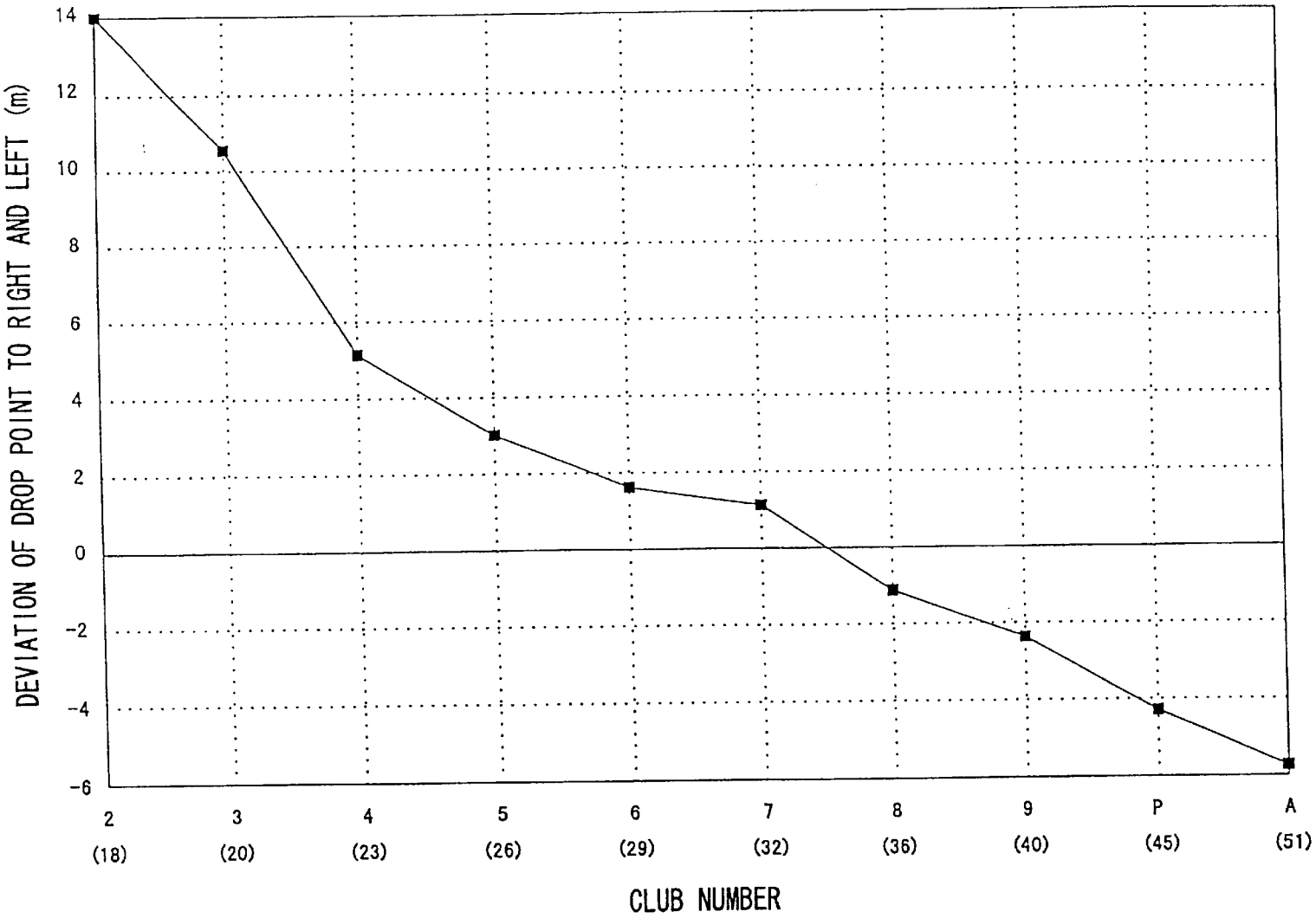
FIG. 20 is a view showing the result of a golf ball hit by clubs of each number of a set of iron clubs.

FIGS. 20 through 25 show the test result: FIG. 20 shows the test result of a set of iron clubs of the comparative example. FIGS. 21 through 25 show the test result of a set of iron clubs of each of the examples 1 through 5. In each of FIGS. 20 through 25, the abscissa is the number of the club and the ordinate is the deviation value of drop points of golf balls with respect to the target value. The positive values indicate the deviation to the right side, and the negative values indicate the deviation to the left side.

Figure 21:
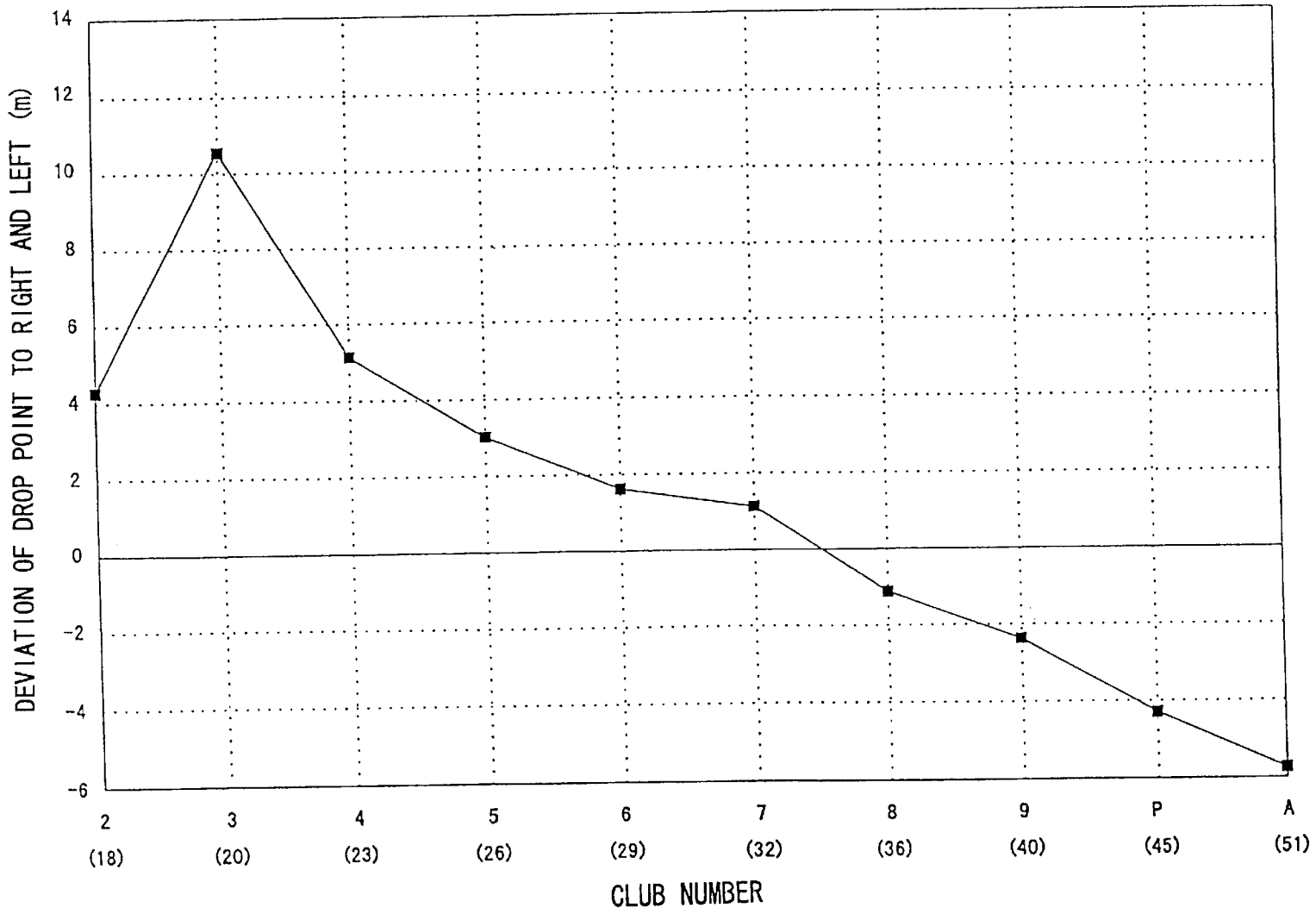
FIG. 21 is a view showing the result of a golf ball hit by clubs of each number of a set of iron clubs.
Figure 22:
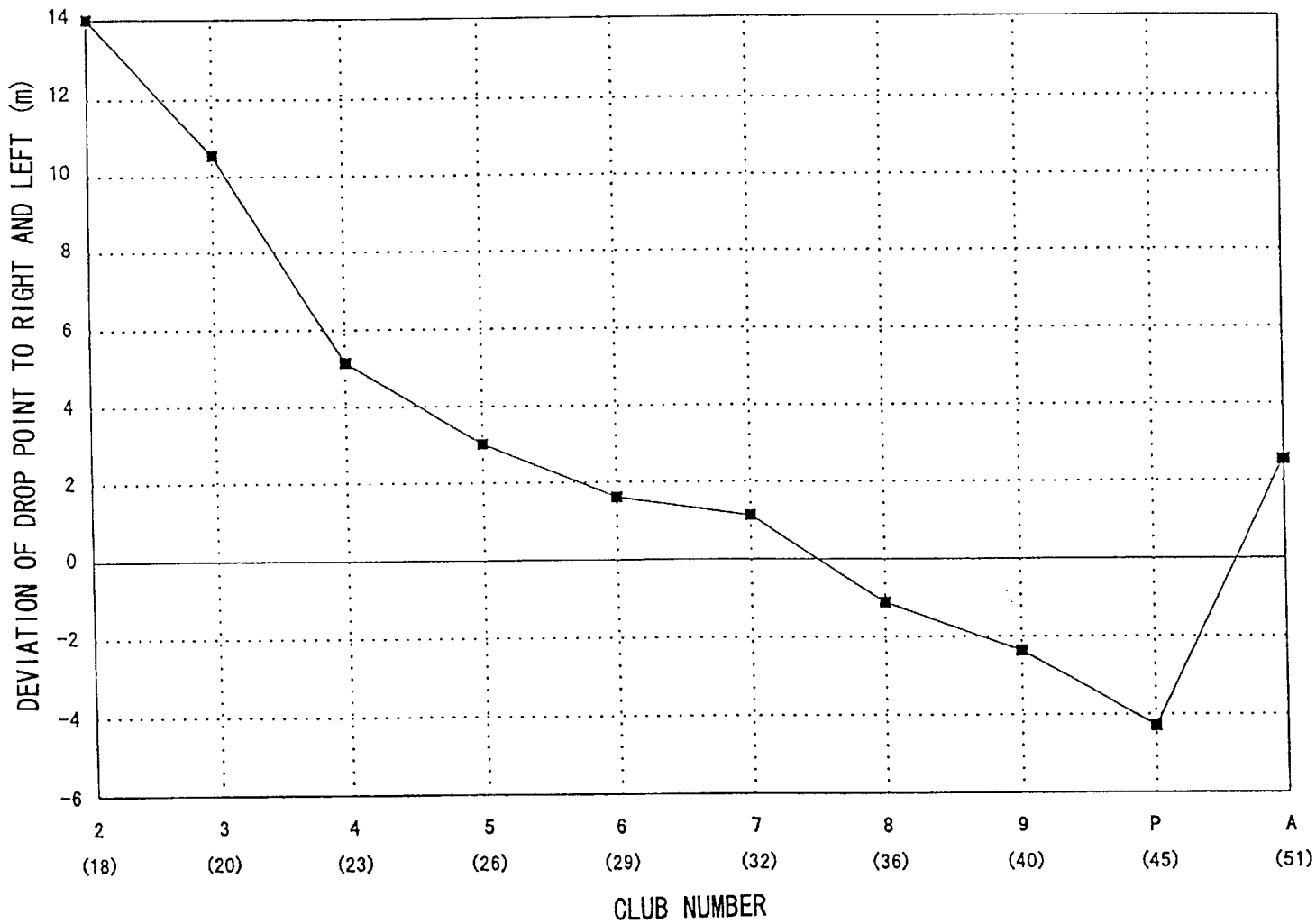
FIG. 22 is a view showing the result of a golf ball hit by clubs of each number of a set of iron clubs.

Referring to FIGS. 20 and 21, in a set of iron clubs of the comparative example, the clubs of each number comprised the sample shaft 1 which was not twisted, whereas in a set of iron clubs of the example 1, the twistable sample shaft 2 in which the principal elastic axis thereof intersected with the specified plane was used for the second iron. Thus, the distance between the target point and the drop point of the golf ball hit by the second iron of a set of iron clubs of the example 1 was smaller than that between the target point and the drop point of the golf ball hit by the second iron of a set of iron clubs of the comparative example. That is, the deviation value in the right side with respect to the target value obtained in the second iron of a set of iron clubs of the example 1 was smaller than that of the golf ball hit in the right side with respect to the target value obtained in the second iron of a set of iron clubs of the comparative example. In a set of iron clubs of the example 2, the twistable sample shaft 2 in which the principal elastic axis thereof intersected with the specified plane was used for an AW (approach wedge). Thus, the distance between the target point and the drop point of the golf ball hit by the AW of a set of iron clubs of the example 2 was smaller than that between the target point and the drop point of the golf ball hit by the AW of a set of iron clubs of the comparative example and the AW of a set of iron clubs of the example 1. That is, the deviation value with respect to the target value obtained in the AW of a set of iron clubs of the example 2 was smaller than that of the golf ball hit with respect to the target value obtained in the AW of a set of iron clubs of the comparative example and the AW of a set of iron clubs of the example 1.

Figure 23:
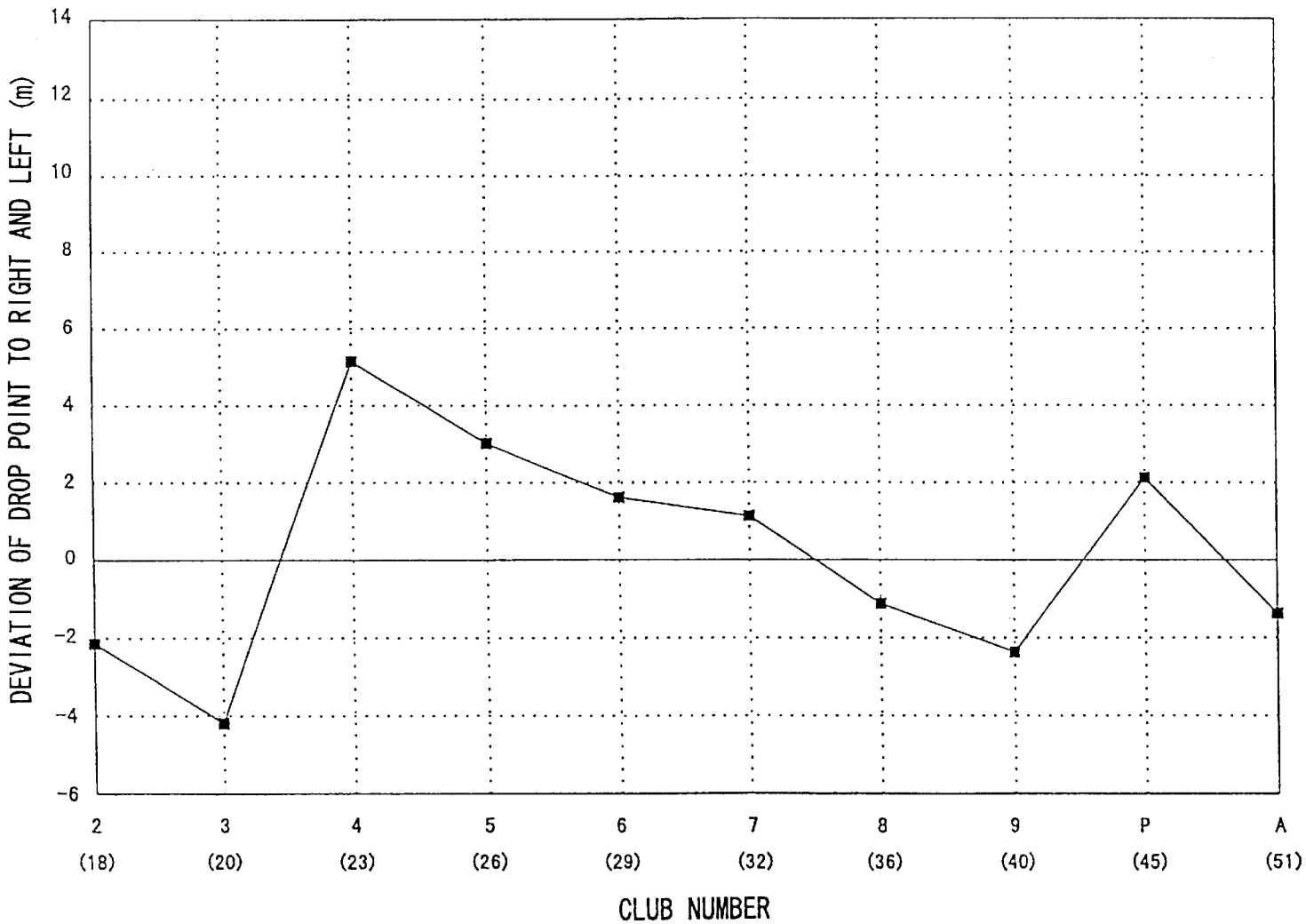
FIG. 23 is a view showing the result of a golf ball hit by clubs of each number of a set of iron clubs.

Referring to FIG. 23, in a set of iron clubs of the example 3, the twistable sample shaft 3 in which the principal elastic axis thereof intersected with the specified plane was used for the second and third irons, and the twistable sample shaft 4 in which the principal elastic axis thereof intersected with the specified plane was used for the PW (pitching wedge) and the AW. Thus, the distance between the target point and the drop point of golf balls hit by the second iron, the third iron, the PW, and the AW of a set of iron clubs of the example 3 was smaller than that between the target point and the drop point of the golf ball hit by those of a set of iron clubs of the comparative example.

Figure 24:
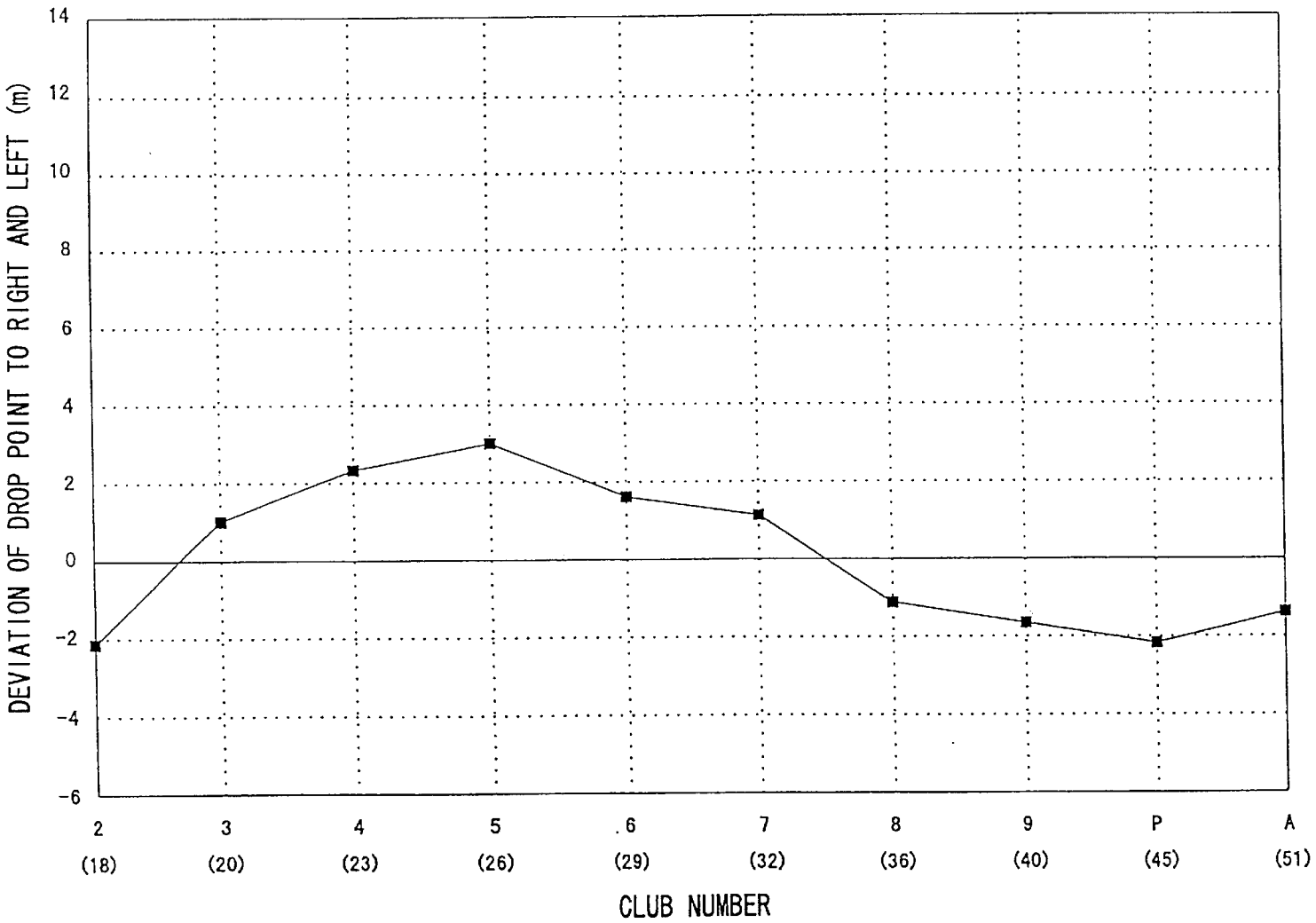
FIG. 24 is a view showing the result of a golf ball hit by clubs of each number of a set of iron clubs.

Referring to FIG. 24, in a set of iron clubs of the example 4, the twistable sample shaft 3 in which the principal elastic axis thereof intersected with the specified plane was used for the second, third, and fourth irons, and the twistable sample shaft 4 in which the principal elastic axis thereof intersected with the specified plane was used for the PW, the AW, and the ninth iron. Thus, the distance between the target point and the drop point of the golf ball hit by the fourth and ninth irons of a set of iron clubs of the example 4 was smaller than that between the target point and the drop point of golf balls hit by those of a set of iron clubs of the example 3.

Figure 25:
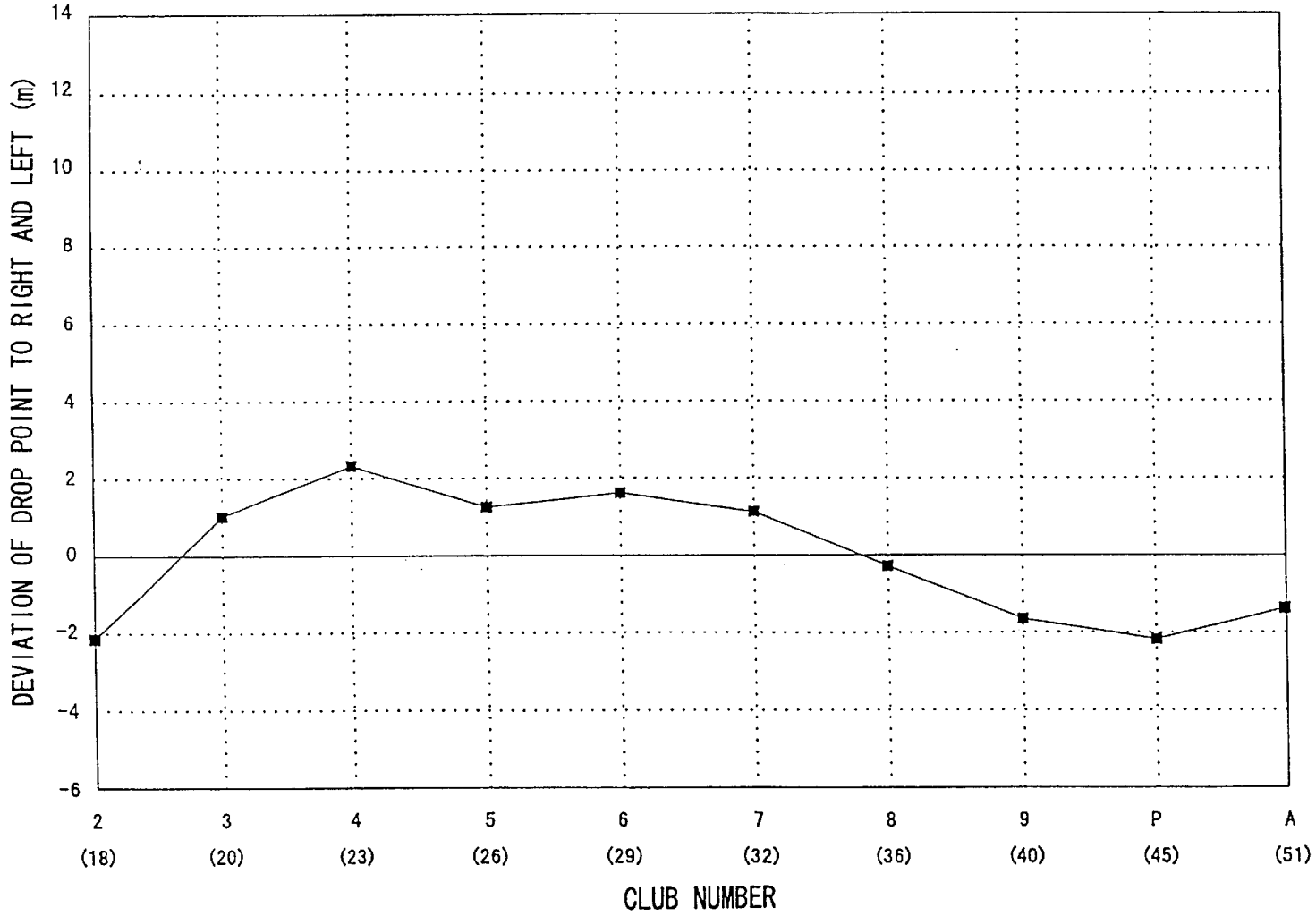
FIG. 25 is a view showing the result of a golf ball hit by clubs of each number of a set of iron clubs.
Figure 26:
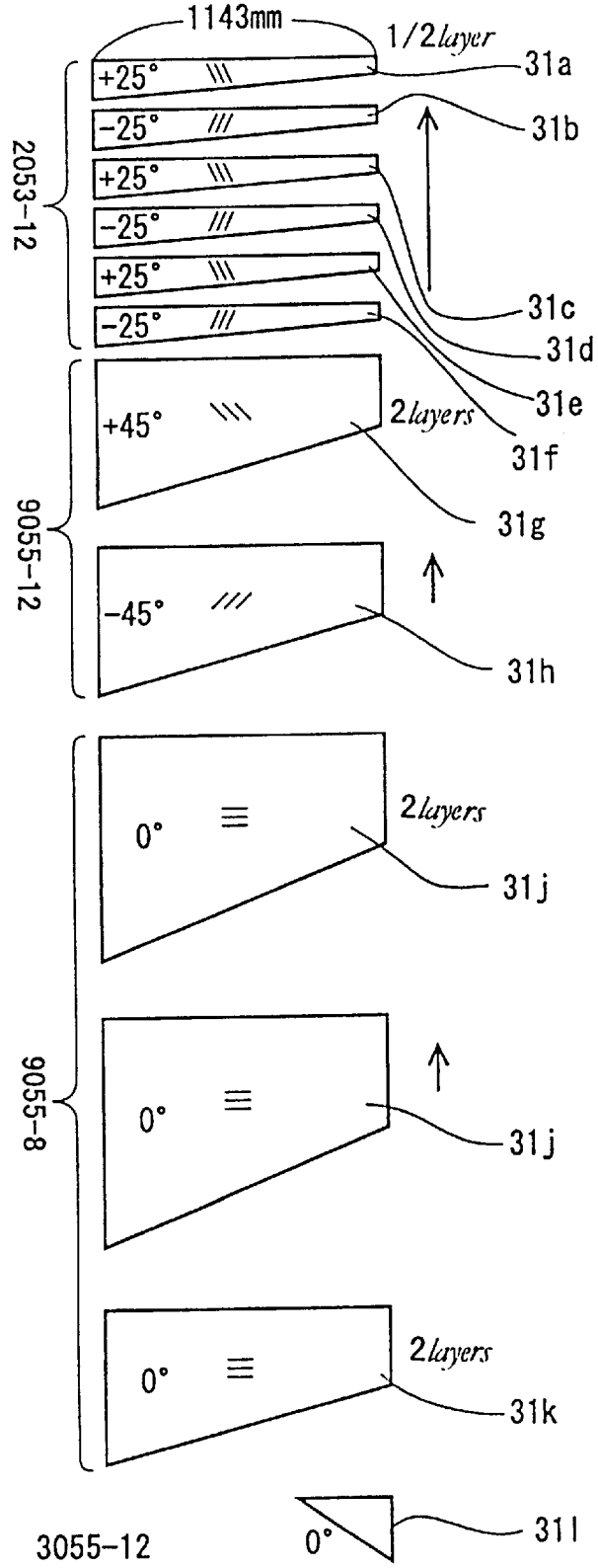
FIG. 26 is a developed view showing prepreg sheets which are used for a golf club shaft of an example of the present invention.

Referring to FIG. 25, in a set of iron clubs of the example 5, the twistable sample shaft 3 in which the principal elastic axis thereof intersected with the specified plane was used for the second, third, fourth, and fifth irons, and the twistable sample shaft 4 in which the principal elastic axis thereof intersected with the specified plane was used for the PW, the AW, the ninth iron, and the eighth iron. Thus, the distance between the target point and the drop point of the golf ball hit by the fifth and eighth irons of a set of iron clubs of the example 5 was smaller than that between the target point and the drop point of golf balls hit by those of a set of iron clubs of the example 4.

It was confirmed from the test result that in the clubs of the low-number side and high-number side comprising the shaft which is deflected and twisted when a load is applied thereto laterally, the orbit thereof and hence the hitting direction are so corrected when it is swung that the distance between the golf ball and the target line or point becomes shorter.

Further, in a set of iron clubs of the examples 4 and 5, it was confirmed that the use of a set of the iron clubs of the examples 4 and 5 improves the directionality of the golf ball by using the shaft which is deflected and twisted for the club of the lowest number and the several clubs of the low-number side succeeding it and the club of the highest number and the several clubs of the high-number side succeeding it. Iron heads were installed in different angles on the shafts of the club of the lowest number and the several clubs of the low-number side succeeding it and the club of the highest number and the several clubs of the high-number side succeeding it to differentiate the intersection angle between the specified plane and the principal elastic axis of the shafts of the iron clubs of the examples 4 and 5 such that the shaft of the club of a higher number at the low-number side had a greater intersection angle than the club of a lower number at the low-number side and that the shaft of the club of a lower number at the high-number side had a greater intersection angle than the club of a higher number at the high-number side. As a result, it was confirmed that the directionality of the golf ball could be improved by the use of a set of the iron clubs of the examples 4 and 5 having the above construction.

Third Embodiment

There were prepared shafts which were used for wood clubs of examples 1 through 3 and wood clubs of comparative examples 1 and 2.

Figure 27:
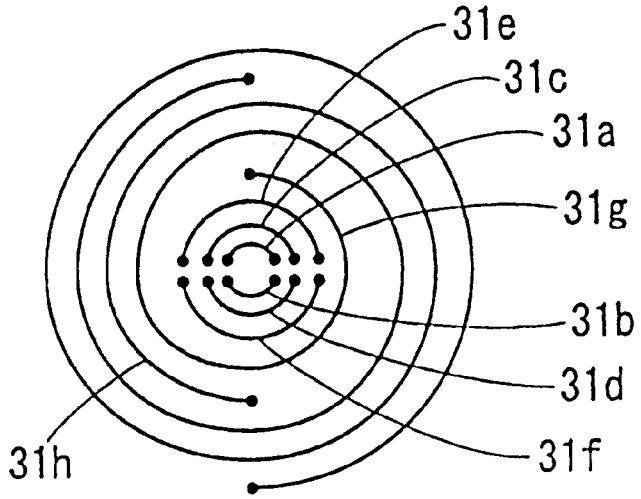
FIG. 27 is a schematic sectional view showing the golf club shaft of an example of the present invention.

The shaft used for the wood club of the example 1 was prepared by sequentially winding on a mandrel prepreg sheets 31*a* shown uppermost in FIG. 26 through 31*l* positioned shown lowermost therein. Then, a thermocompression tube is spirally wrapped on the prepreg sheets and then, the prepreg sheets and the thermocompression tube were heated to cure them. Then, the mandrel is pulled out from the resulting shaft. The triangular prepreg sheet 31*l* was wound on one end (diameter-smaller side) of the shaft on which a head is installed to reinforce the shaft. The numerical value attached to each of the prepreg sheets 31*a* through 31*l* indicates the orientation angle of reinforced fiber thereof with respect to the axis of the shaft (axis of mandrel). For example, 0° indicates that the reinforced fiber was oriented in parallel with the axis of the mandrel. +25° and −25° indicate that the reinforced fiber was oriented at 25° in opposite directions with respect to the axis of the mandrel. +45° and −45° indicate that the reinforced fiber was oriented at 45° in opposite directions with respect to the axis of the mandrel. The numerical value attached to the right of each prepreg sheet indicates the number of layers of the prepreg sheets laminated on the mandrel in the circumferential direction of the shaft. The numerical values attached to the left of the prepreg sheets indicate the product numbers (manufactured by Toray Co., Ltd.) of each prepreg sheet. FIG. 27 shows how the prepreg sheets 31*a* through 31*h* were wound. FIG. 27 does not show the straight layers consisting of the prepreg sheets 31*j* and 31*k* the reinforced fibers of which were oriented at 0° with respect to the axis of the mandrel and the reinforcing prepreg sheet 31*l*.

The prepreg sheets were formed of reinforced fiber consisting of carbon fiber impregnated with epoxy resin. The prepreg sheets 2053-12 had a tensile modulus of 30000 kg/mm$^2$, a tensile strength of 560 kg/mm$^2$, a thickness of 0.1137 mm. The prepreg sheets 9055-12 had a tensile modulus of 38500 kg/mm$^2$, a tensile strength of 450 kg/mm$^2$, a thickness of 0.0961 mm. The prepreg sheets 9055-8 had a tensile modulus of 38500 kg/mm$^2$, a tensile strength of 450 kg/mm$^2$, a thickness of 0.0622 mm.

Figure 28:
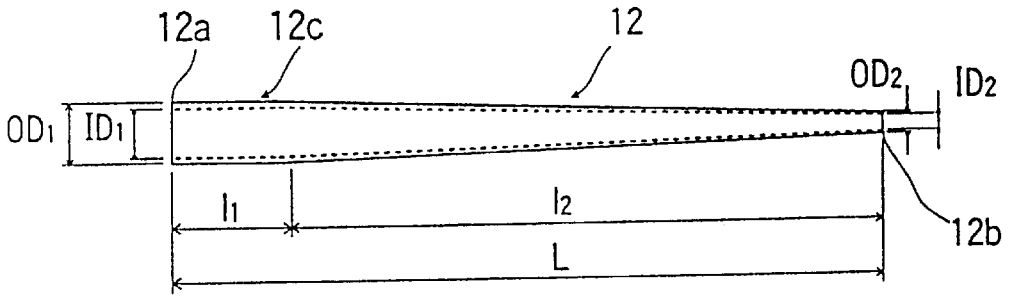
FIG. 28 is an explanatory view explaining the dimension of the golf club shaft of an example of the present invention.

FIG. 28 shows the dimension of the shaft. The entire length (L) of the shaft 12 is 1143 mm. Describing a grip portion 12*c* of the shaft 12, the outer diameter $OD_1$ and the inner diameter $ID_1$ at one end 12*a* thereof on which a grip is to be mounted is set to 15 mm and 13 mm, respectively; and the outer diameter $OD_1$ and the inner diameter $ID_1$ of the grip portion 12*c* are set to the same length, respectively in the region of $l_1$=150 mm from one end 12*a* thereof to the other end thereof. The region from one end of the grip portion 12*c* to the other end 12*b* of the shaft 12 on which a head (hereinafter referred to as merely head) 14 is to be mounted has a length $l_2$=993 mm and is tapered to the end 12*b*. The outer diameter $OD_2$ of the shaft 12 and the inner diameter $ID_2$ thereof at the other end 12*b* are set to 8.55 mm and 3.5 mm, respectively.

Figure 29:
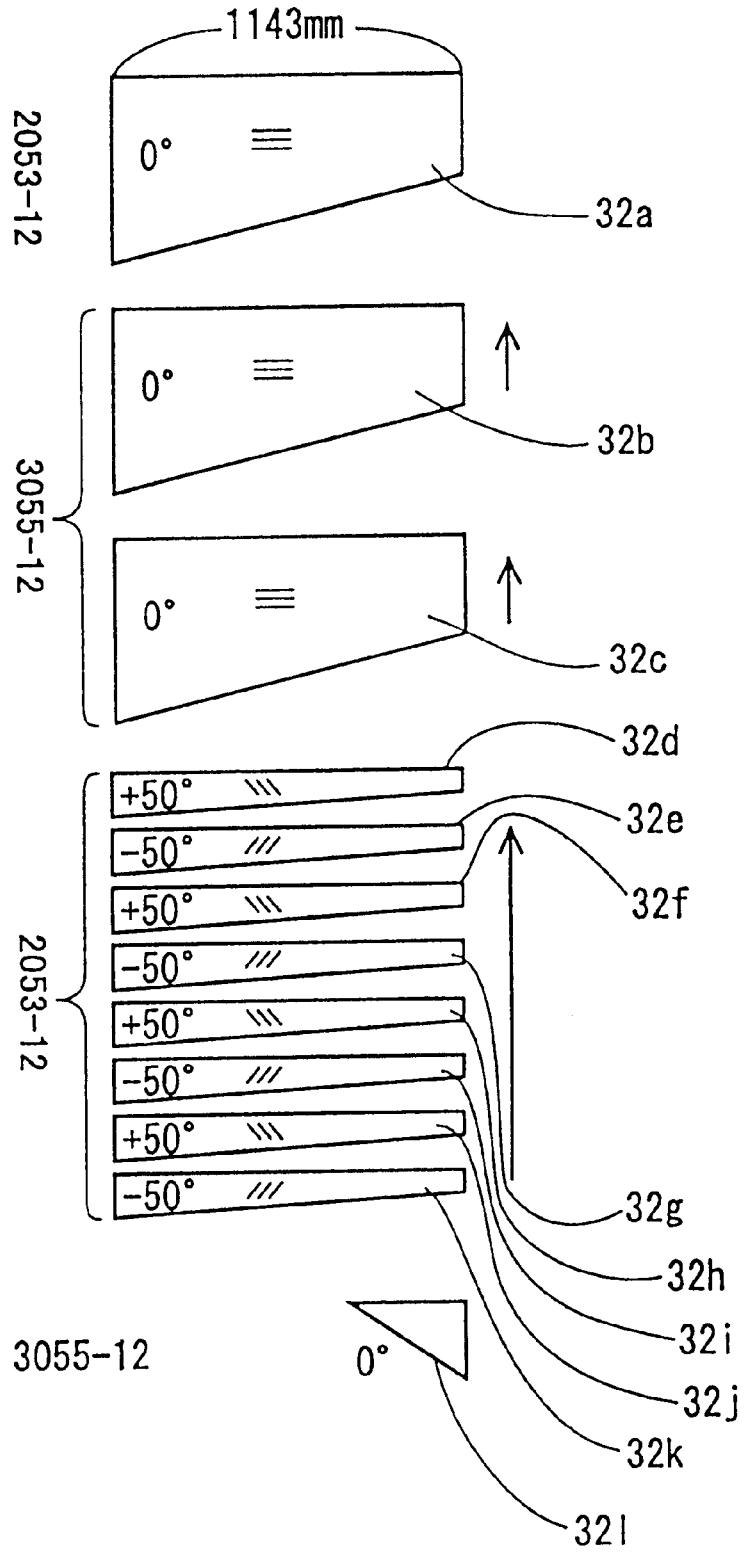
FIG. 29 is a developed view showing prepreg sheets which are used for a golf club shaft of an example of the present invention.
Figure 30:
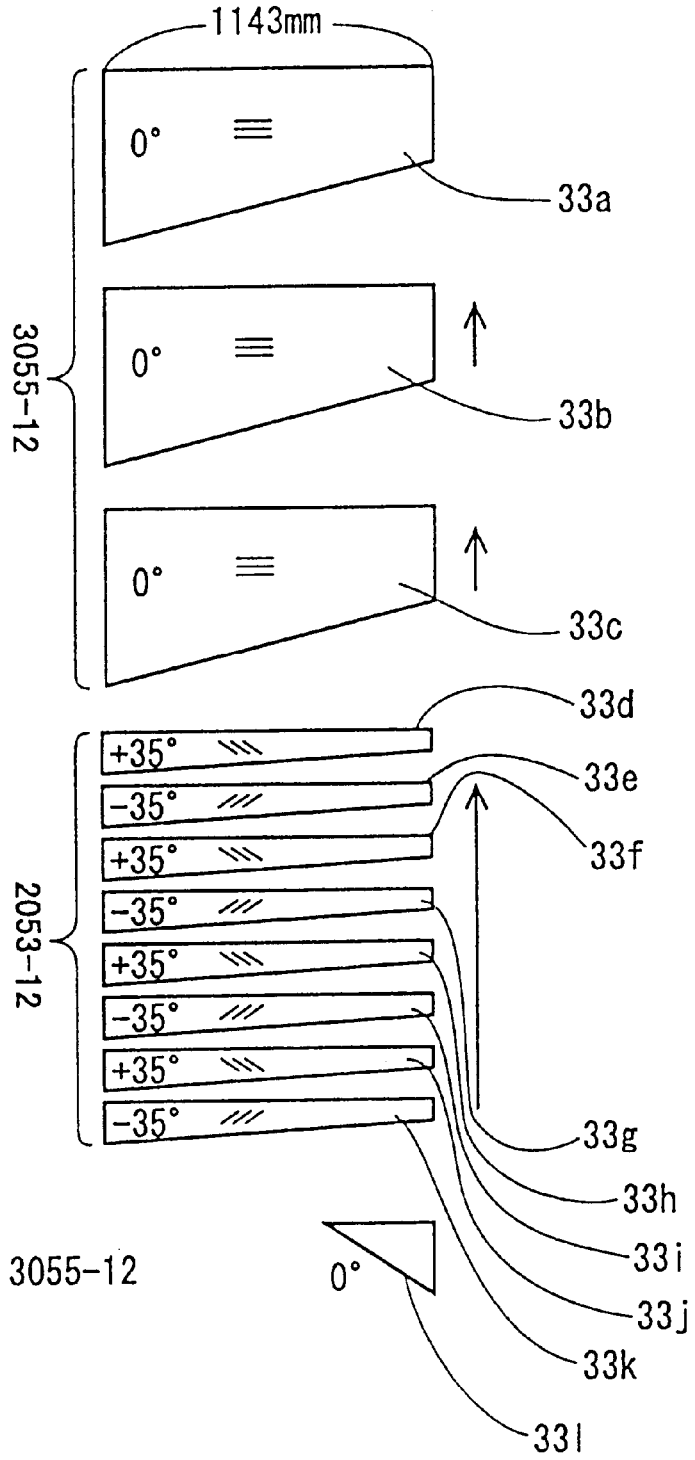
FIG. 30 is a developed view showing prepreg sheets which are used for a golf club shaft of an example of the present invention.

FIGS. 29 and 30 show a prepreg sheet used for the club of each of the example 2 and the example 3. The shaft of each of the examples 2 and 3 was prepared by a method similar to that used to form the shaft of the club of the example 1 by sequentially winding prepreg sheets 32*a*–32*l* (FIG. 29) and prepreg sheets 33*a*–33*l* (FIG. 30) on a mandrel, respectively in the order from the one shown uppermost in FIG. 29 to the one shown lowermost therein and in the order from the one shown uppermost in FIG. 30 to the one shown lowermost therein, respectively. The triangular prepreg sheet 32*l* and 33*l* shown in FIGS. 29 and 30, respectively were wound on one end (diameter-smaller side) of the shaft on which a head is installed to reinforce the shaft. The numerical value attached to each of the prepreg sheets indicates the orientation angle of reinforced fiber thereof with respect to the axis of the shaft (axis of mandrel). The numerical value attached to the right of each prepreg sheet indicates the number of layers of the prepreg sheets laminated on the mandrel in the circumferential direction of the shaft. The numerical values attached to the left of the prepreg sheets indicate the product numbers of each prepreg sheet. The prepreg sheets 2055-12 (manufactured by Toray Co., Ltd.) had a tensile modulus of 235000 kg/mm$^2$, a tensile strength of 500 kg/mm$^2$, and a thickness of 0.0961 mm.

Figure 31:
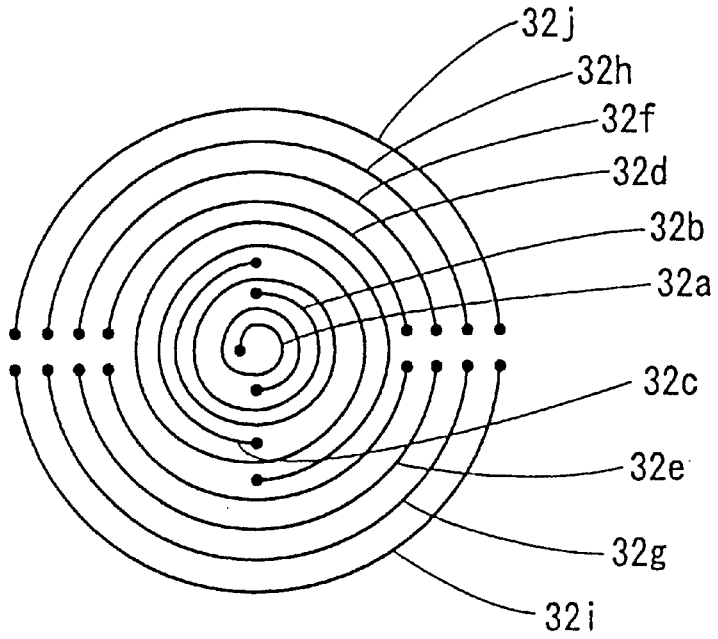
FIG. 31 is a schematic sectional view showing the golf club shaft of the example of the present invention.
Figure 32:
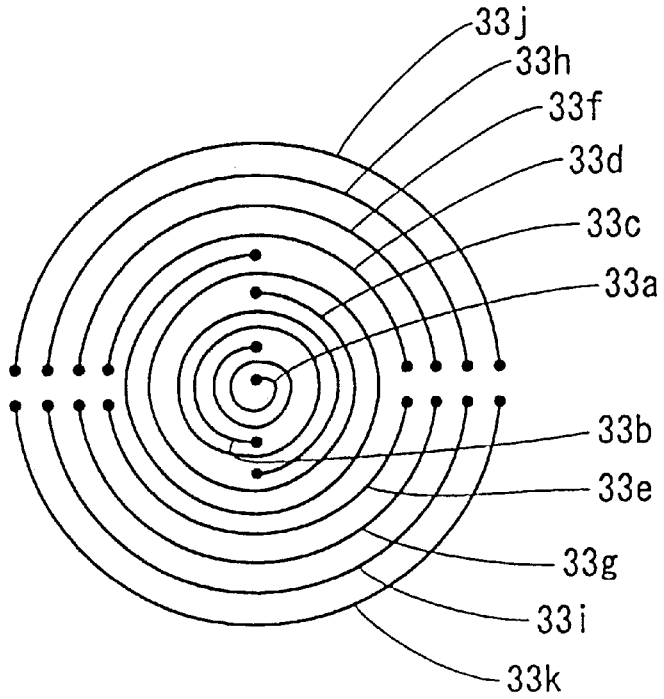
FIG. 32 is a schematic sectional view showing the golf club shaft of the example or the present invention.

FIGS. 31 and 32 show how the prepreg sheets 32*a* through 32*k* and the prepreg sheets 33*a* through 33*k* were wound, respectively. FIGS. 31 and 32 do not show the reinforcing prepreg sheet.

Figure 34:
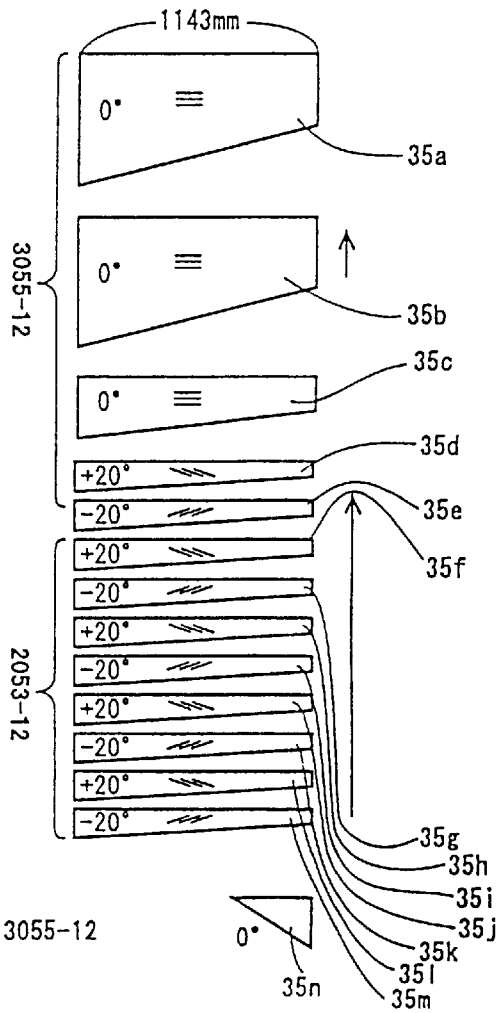
FIG. 34 is a developed view showing prepreg sheets which are used for a golf club shaft of a comparative example in comparison with the golf club shafts shown in FIGS. 26 through 32.
Figure 33:
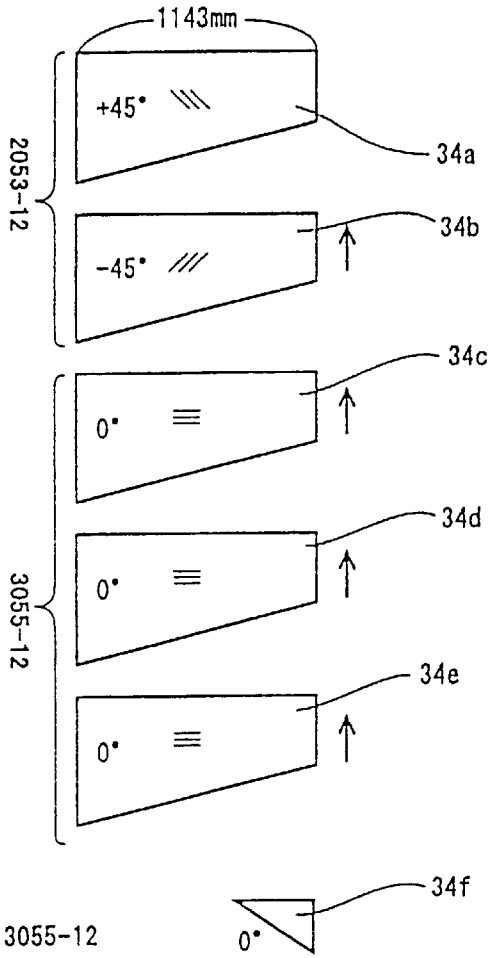
FIG. 33 is a developed view showing prepreg sheets which are used for a golf club shaft of a comparative example in comparison with the golf club shafts shown in FIGS. 26 through 32.
Figure 35:
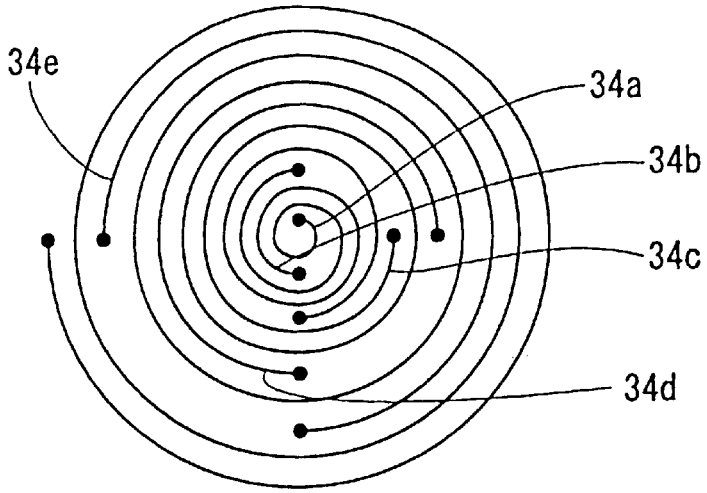
FIG. 35 is a schematic sectional view showing the golf club shaft of the comparative example 1 in comparison with the golf club shafts shown in FIGS. 26 through 32.
Figure 36:
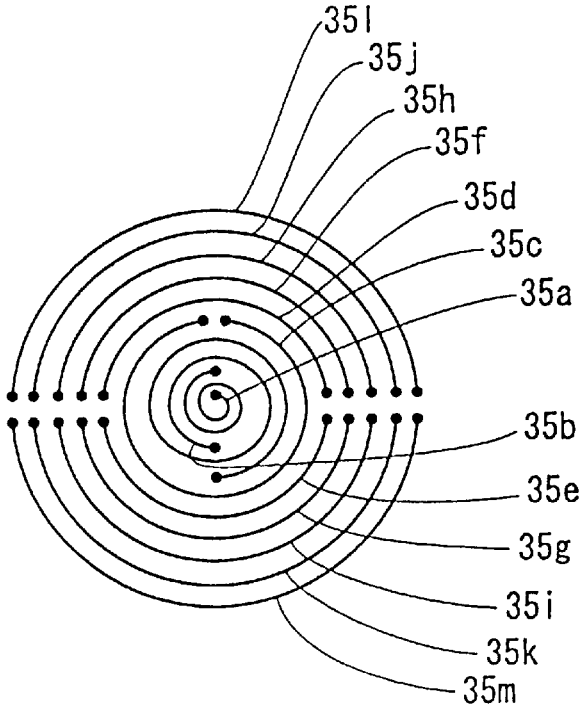
FIG. 36 is a schematic sectional view showing the golf club shaft of the comparative example in comparison with the golf club shafts shown in FIGS. 26 through 32.

Using prepreg sheets 34*a* through 34*f* and prepreg sheets 35*a* through 35*n* shown in FIGS. 33 and 34, respectively, the shaft of the comparative example 1 and the shaft of the comparative example 2 were prepared by a method similar to the above-described one. FIGS. 35 and 36 show how the prepreg sheets 34*a* through 34*e* and the prepreg sheets 35*a* through 35*m* were wound, respectively. FIGS. 35 and 36 do not show the reinforcing prepreg sheet.

Figure 37:
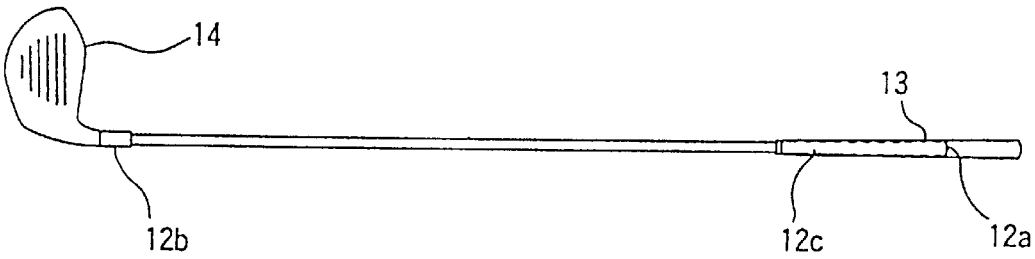
FIG. 37 is a view showing a golf club assembled from the golf club shafts shown in FIGS. 26 through 32.

Referring to FIG. 37, using each shaft prepared as described above, a wood type head 14 on which titanium alloy was installed was mounted on the leading end 12*b* of a shaft 12, and an outer member 13 made of rubber was fixed to a grip portion 12*c* of the shaft 12 to prepare a club of each of the examples 1 through 3 and the comparative examples 1 and 2.

The clubs of each of the examples 1 through 3 and the comparative examples 1 and 2 were prepared for the slicer and the hooker.

Regarding the club for the slicer, the head 14 was installed on the shaft and the club was placed on the horizontal plane in a predetermined state (state as shown in FIGS. 1 and 2). Supposing that a plane parallel with an intersection line formed by the intersection of a front face of the head 14 and a horizontal plane and including a principal geometrical axis (G) of the shaft is set as a specified plane 200, the principal elastic axis (E) of the shaft is so positioned that a plane 100 including the principal elastic axis (E) and the principal geometrical axis (G) intersect with the specified plane 200 at an intersection angle of 90°, with a region of 150 mm of the shaft with respect to an end at a grip side thereof fixed; and the principal elastic axis (E) of the shaft is positioned in the head rear face-side space, with the specified plane 200 set as the boundary between the head rear face-side space and the head front face-side space. Regarding the club for the hooker, the plane 100 including the principal elastic axis (E) intersects with the specified plane 200 at an intersection angle of 90°; and the principal elastic axis (E) of the shaft is positioned in the head front face-side space, with the specified plane 200 set as the boundary between the head rear face-side space and the head front face-side space.

Figure 6:
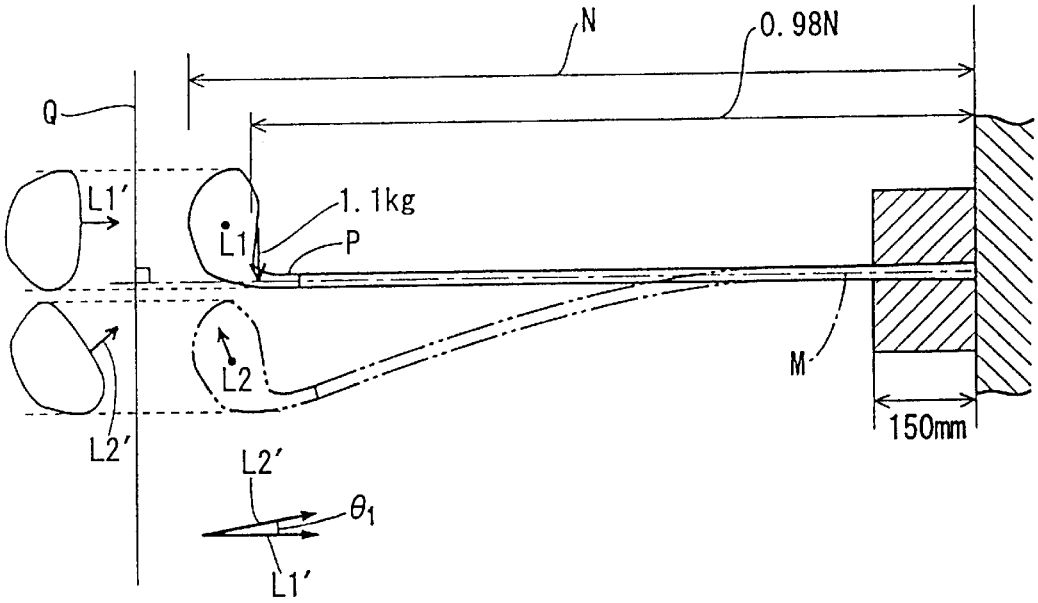
FIGS. 6A and 6B are explanatory views each explaining the deformation behavior of the shaft of the golf club of the present invention.
Figure 6:
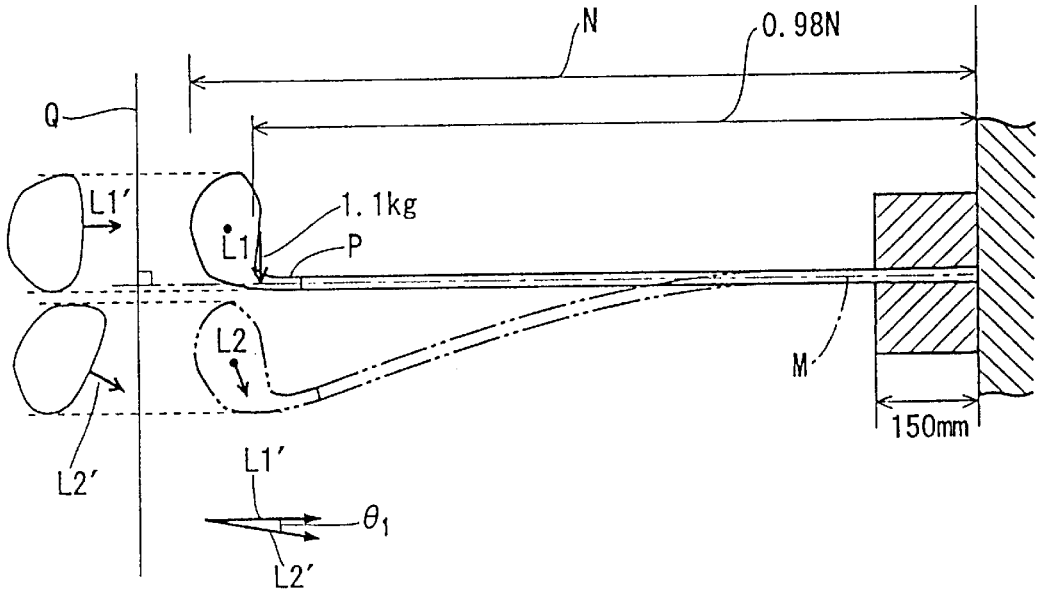
Figure 38:
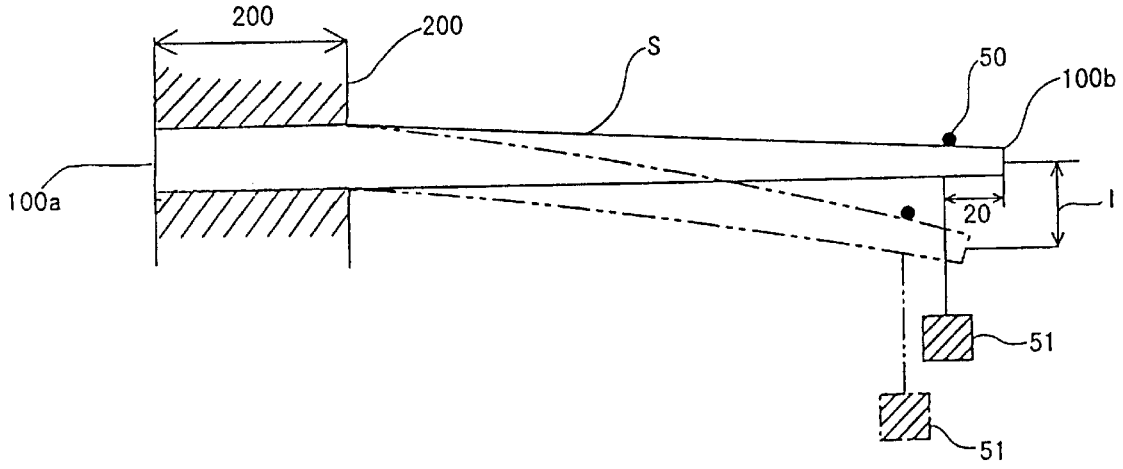
FIGS. 38A and 38B are views showing a method of measuring the deflection amount and twist angle of the golf club shaft.
Figure 38:
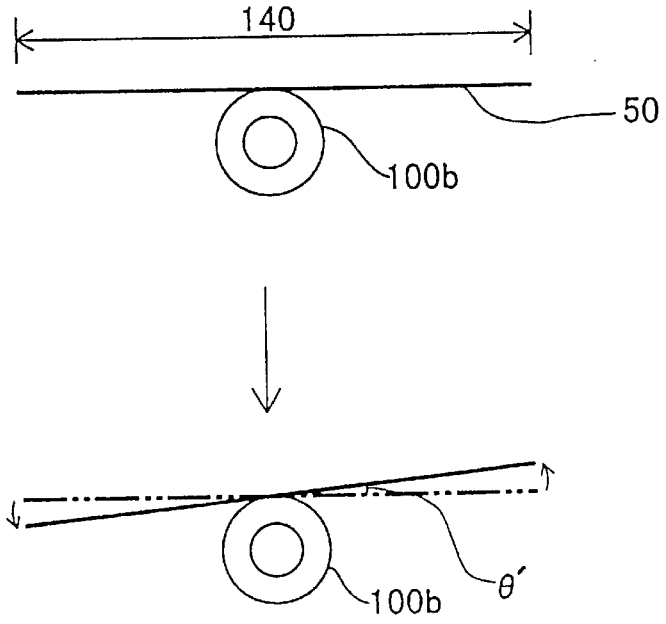
Figure 39:
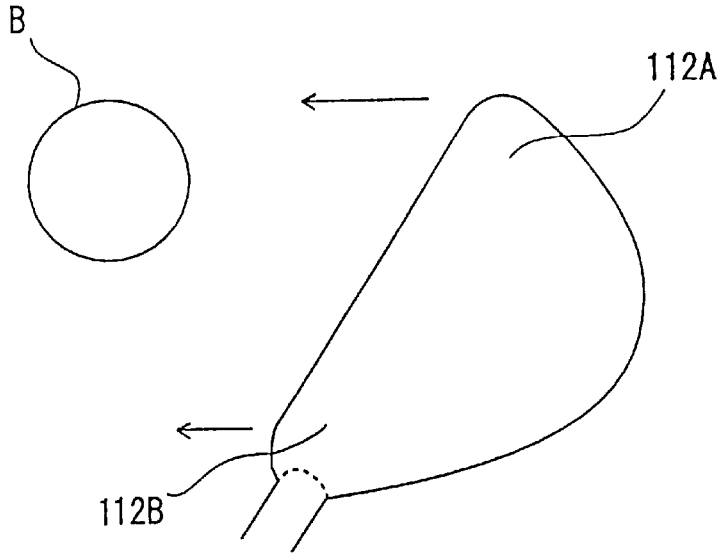
FIGS. 39A and 39B are views for explaining the conventional problem.
Figure 39:
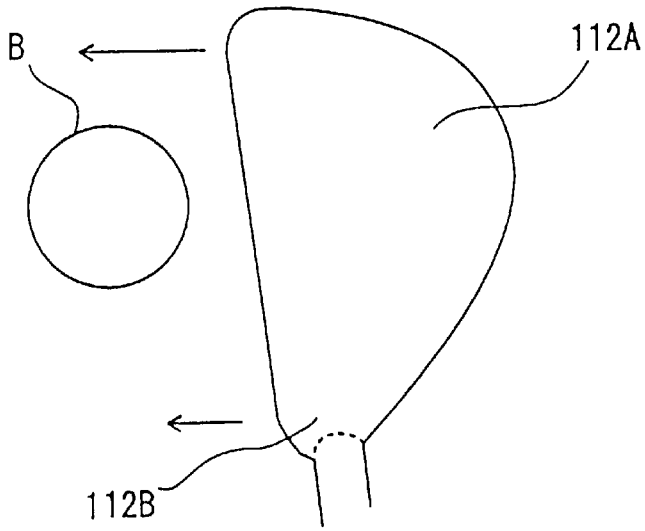
Figure 40:
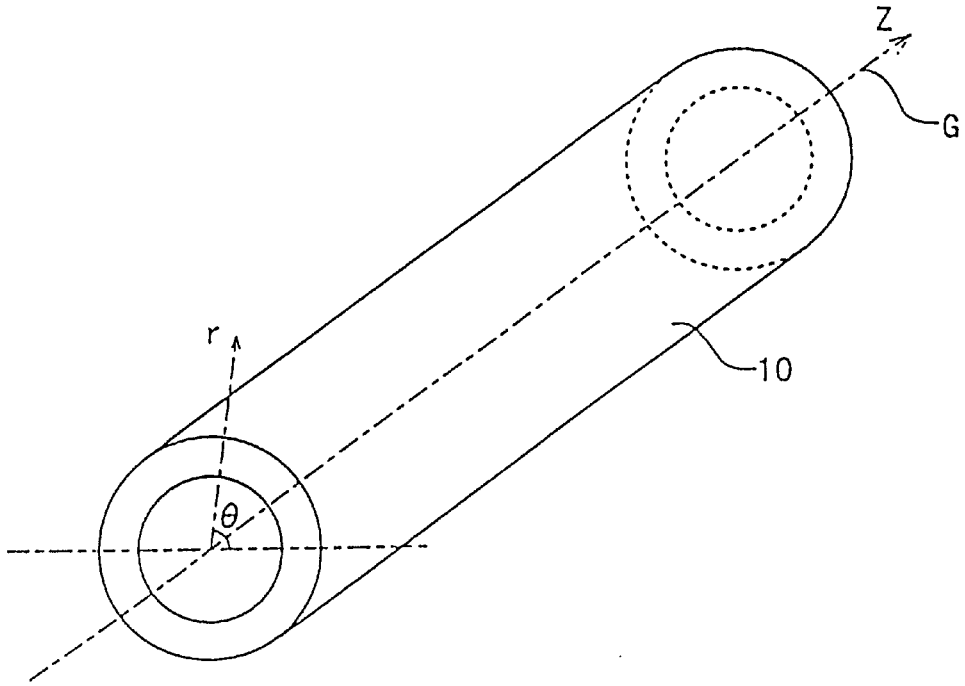
FIG. 40 is a schematic perspective view showing a pipe-shaped construction for explaining the principle of the present invention.
Figure 41:
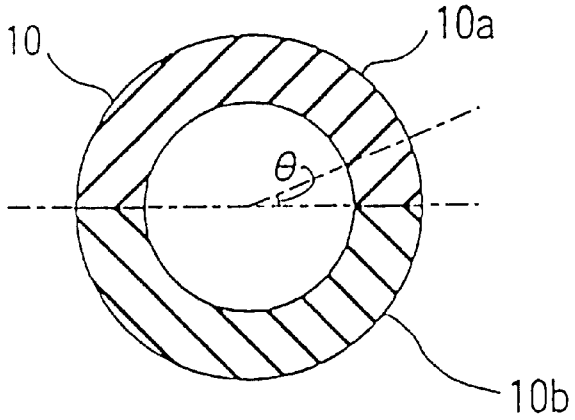
FIG. 41 is a sectional view showing the pipe-shaped construction shown in FIG. 40.
Figure 42:
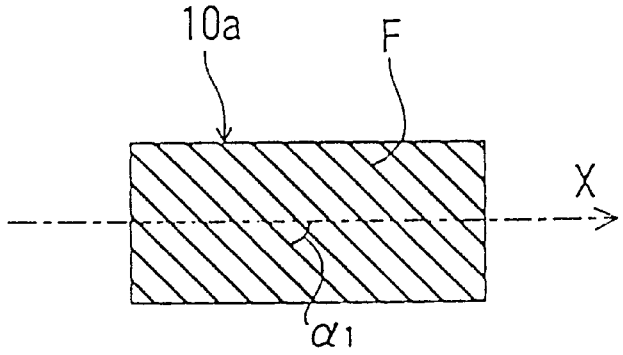
FIG. 42 is a schematic view showing the fibrous angle of the pipe-shaped construction shown in FIG. 40.
Figure 43:
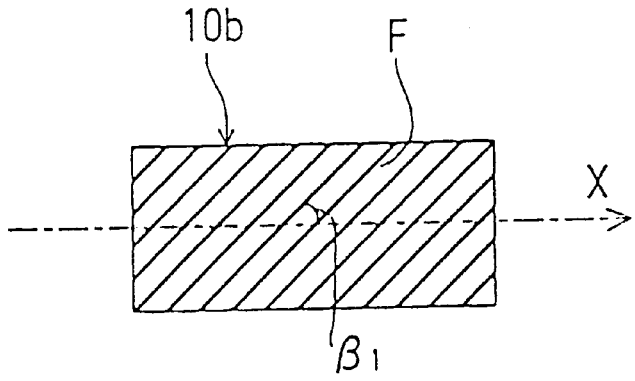
FIG. 43 is a schematic view showing the fibrous angle of the pipe-shaped construction shown in FIG. 40.
Figure 44:
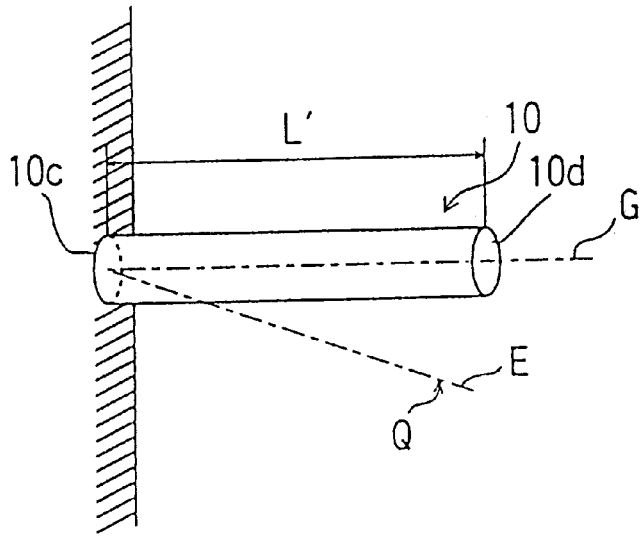
FIG. 44 is a schematic view showing the deformation behavior of a pipe.
Figure 45:
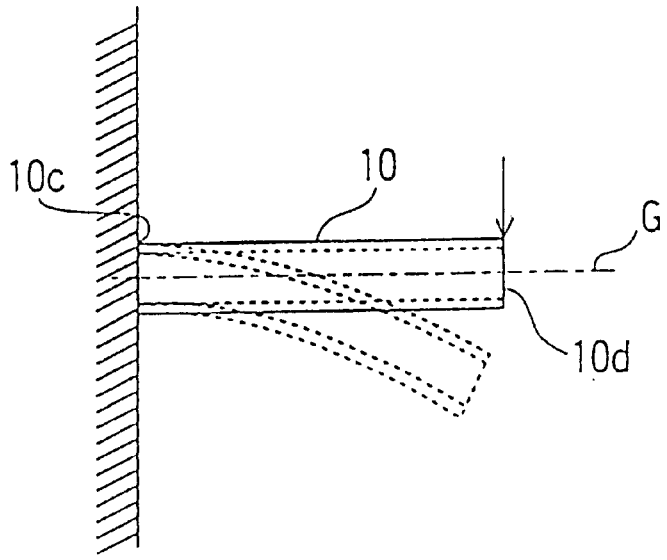
FIG. 45 is a schematic view showing the deformation behavior of the pipe.
Figure 46:
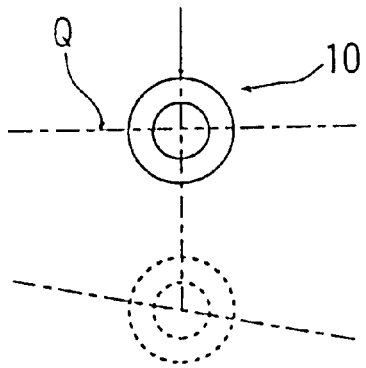
FIG. 46 is a schematic view showing the deformation behavior of the pipe.
Figure 47:
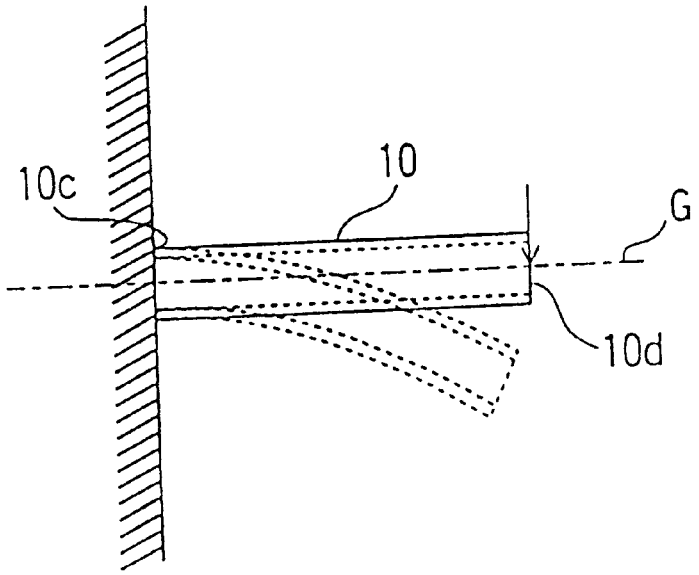
FIG. 47 is a schematic view showing the deformation behavior of the pipe.
Figure 48:
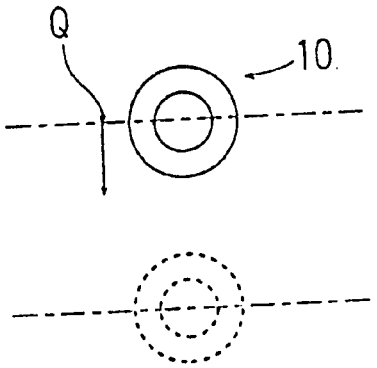
FIG. 48 is a schematic view showing the deformation behavior of the pipe.

The following test was conducted on each shaft before the head was installed thereon. That is, as shown in FIG. 38, a shaft (S) was held by a chucking device 200 which chucked a region thereof having a length of 150 mm from an end 12*a* at a grip side 12*c* of a shaft 12, with the shaft 12 held horizontally. The center of a metal wire 50 having a length of 140 mm was bonded to the upper surface of the shaft 12 at a position thereof which was spaced by a length corresponding to 98% of the entire length of the club with respect to the end 12*a* at the grip side 12*c* of the shaft 12 such that the metal wire 50 is horizontal and at a right angle with the axis of the shaft 12. A weight 51 having a weight of 1.1 kg was hung from the shaft 12 at the lower end of the position thereof which was spaced by the length corresponding to 98% of the entire length of the club with respect to the end 12*a* at the grip side 12*c* of the shaft 12 to measure the deflection amount and twist amount of the shaft 12. The twist amount of the shaft 12 was determined by measuring a rotation angle (θ') of the metal wire 50 with respect to the point of contact between the metal wire 50 and the shaft 12 before the load was applied to the shaft 12. The rotation angle (θ') corresponds to the intersection angle ($\theta_1$) which is formed between the lines L1' and L2' shown in FIG. 6.

Using the club of each of the examples 1 through 3 and the comparative examples 1 and 2 prepared for the hooker and the slicer, golf balls were hit 15 times by three hookers (A, B, and C) having different degrees of hook and three slicers (D, E, and F) having different degrees of slice, respectively. The number of sidespins directly relating to the curve of the golf ball to the right or left were measured for each golf ball, and the average thereof was calculated. It is to be noted that the hookers and the slicers were in low and middle grades and had 1–5 years' experience in golf.

TABLE 9

| | Comparative Example 1 | Example 1 | Example 2 | Example 3 | Comparative Example 2 |
|---|---|---|---|---|---|
| θ (°) | 0 | 0.8 | 1.4 | 3.3 | 5.6 |
| Tester A | −369 | −81 | 254 | 673 | 1416 |
| Tester B | −788 | −317 | 66 | 206 | 742 |
| Tester C | −1457 | −994 | −402 | −107 | 371 |
| Tester D | 275 | −55 | −41 | −735 | −1286 |
| Tester E | 948 | 480 | 10 | −338 | −806 |
| Tester F | 1188 | 872 | 510 | 122 | −304 |

The positive values in table 9 correspond to the right-handed rotation of the golf ball, whereas the negative values in table 9 correspond to the left-handed rotation thereof. That the number of sidespins is −200 to 200 indicates that the course of the golf ball was almost straight. That the number of sidespins is −200 to −500 indicates that the course of the golf ball hooked to the left in a low degree. That the number of sidespins is 200 to 500 indicates that the course of the golf ball sliced to the right in a low degree. That the number of sidespins is less than −500 indicates that the golf ball hooked to the left in a high degree. That the number of sidespins is more than 500 indicates that the golf ball sliced to the right in a high degree.

Table 9 indicates that the number of sidespins in the hook-causing left-handed rotation of golf balls hit by the hookers (A), (B), and (C) by the clubs of the examples 1, 2, and 3 is allowed to be smaller than that of sidespins of golf balls hit by them by the club of the comparative example 1 (conventional shaft) in which the principal geometrical axis and the principal elastic axis were coincident with each other and when a load is applied to the principal geometrical axis, the shaft was not twisted. That is, table 9 indicates that the self-correcting effect of the direction of the head was provided by the clubs of the examples 1, 2, and 3. More specifically, when the tester (A) having a low degree of hook used the club in which the twist amount (rotation angle (θ') of metal wire 50) of the shaft of the example 1 was 0.8°, the course of the golf ball hit by the tester (A) was corrected to be almost straight (number of sidespins: −81). When the tester (B) having a medium degree of hook used the club in which the twist amount (rotation angle (θ") of metal wire 50) of the shaft of the example 2 was 1.4°, the course of the golf ball hit by the tester (B) was corrected to be almost straight (number of sidespins: 66). When the tester (C) having a high degree of hook used the club in which the twist amount (rotation angle (θ') of metal wire 50) of the shaft of the example 3 was 3.3°, the course of the golf ball hit by the tester (C) was corrected to be almost straight (number of sidespins: −107).

On the other hand, when the testers (A), (B), and (C) used the club in which the twist amount (rotation angle (θ') of metal wire 50) of the shaft of the comparative example 2 was 5.6°, the number of sidespins in the hook-causing left-handed rotation of the golf ball was reduced, but the self-correcting effect of the direction of the head was so great, i.e., the twist amount of the shaft was so great that golf balls hit by any of the testers (A), (B), and (C) had more than 200 in the number of sidespins and sliced in a high degree.

Table 9 also indicates that the number of sidespins in the slice-causing right-handed rotation of golf balls hit by the slicers (D), (E), and (F) by the clubs of the examples 1, 2, and 3 is allowed to be smaller than the number of sidespins of golf balls hit by them by the club of the comparative example 1 (conventional shaft) in which the principal geometrical axis and the principal elastic axis were coincident with each other and when a load is applied to the principal geometrical axis, the shaft was not twisted. That is, similarly to the above case, table 9 indicates that self-correcting effect of the direction of the head was provided by the clubs of the examples 1, 2, and 3. More specifically, when the tester (D) having a low degree of slice used the club of the shaft of the example 1, the course of the golf ball hit by the tester (D) was corrected to be almost straight (number of sidespins: −55). When the tester (E) having a medium degree of slice used the club of the shaft of the example 2, the course of the golf ball hit by the tester (E) was corrected to be almost straight (number of sidespins: 10). When the tester (F) having a high degree of slice used the club of the shaft of the example 3, the course of the golf ball hit by the tester (F) was corrected to be almost straight (number of sidespins: 122).

On the other hand, when the testers (D), (E), and (F) used the club in which the twist amount (rotation angle (θ') of metal wire 50) of the shaft of the comparative example 2 was 5.6°, the number of sidespins in the slice-causing right-handed rotation of the golf ball was reduced, but the self-correcting effect of the direction of the head was so great, i.e., the twist amount of the shaft was so great that golf balls hit by any of the testers (A), (B), and (C) had more than −200 in the number of sidespins and hooked in a high degree.

It is confirmed from the test result that the hooker and the slicer can hit golf balls almost straight without being conscious of correcting their singing forms by selecting clubs which suit for their swinging form, namely, by selecting clubs in which a shaft has a twist amount (rotation angle (θ') of wire 50) in the range of $0.8° \leqq \theta' \leqq 3.3°$.

Using clubs in which the twist amount (rotation angle (θ') of wire 50) of shafts were different from the above-described amount, golf balls were hit by several players having hook and slice of different degrees from the testers (A, B, C, D, E, and F). The result was that the hooker (slicer) can hit golf balls almost straight without being conscious of correcting their singing forms by selecting clubs according to the degree of hook (slice), namely, by selecting clubs in which a shaft has a twist amount (rotation angle (θ') of wire 50) in the range of $0° < \theta' \leqq 3.5°$.

As apparent from the foregoing description, the present invention provides a golf club allowing the direction of the front face of the club head installed on an end of a golf club shaft to be substantially coincident with the direction in which a golf ball should fly, even though a slicer and a hooker swings the golf club shaft without being conscious of correcting their swinging forms.

Further, according to the present invention, it is unnecessary for golfers to be conscious of the orbit of a golf club of the low-number side and that of a golf club of the high-number side. That is, even though they swing the golf club shaft of the low-number side and the high-number side without being conscious of correcting their swinging forms, the direction of the front face of the club head can be substantially coincident with the direction in which golf balls should fly.

What is claimed is:

1. A set of golf clubs comprising:

a plurality of irons of different lofts;

a shaft of each of said plurality of irons formed partially of an anisotropic material of at least one of fiber reinforced resin, fiber reinforced rubber, and orientative rubber or a plurality thereof combined with each other such that a part of a fiberous or orientation angle of said anisotropic material is differentiated from other portions thereof partly in a circumferential direction of said shaft and in at least one portion in a thickness direction of said shaft, wherein a principal geometrical axis extends through said shaft, and wherein a principal elastic axis extends through a point approximately 200 mm from a grip end of said shaft along said principal geometrical axis and through a point remote from said principal geometrical axis; and a club head attached to a head end of each shaft, wherein an intersection line is formed by an intersection of a front face plane of said club head and a horizontal plane when said golf club is in a normal ball addressing position, and wherein a first plane including said principal geometrical axis is parallel to said intersection line, and wherein said principal elastic axis is positioned such that a second plane including said principal elastic axis and said principal geometrical axis intersects with said first plane at an intersection angle of approximately 45 to 90 degrees, wherein said club head is divided into a front face space and a rear face space, with said first plane forming the boundary between said front face space and said rear face space, wherein said plurality of irons of different lofts includes a first iron of least loft and a second iron of greatest loft, and wherein said principal elastic axis exists in said rear face space of said first iron and in said front face space of said second iron.

2. A set of golf clubs comprising:

a plurality of irons of different lofts;

a shaft of each of said plurality of irons formed partially of an anisotropic material of at least one of fiber reinforced resin, fiber reinforced rubber, and orientative rubber or a plurality thereof combined with each other such that a part of a fiberous or orientation angle of said anisotropic material is differentiated from other portions thereof partly in a circumferential direction of said shaft and in at least one portion in a thickness direction of said shaft, wherein a principal geometrical axis extends through said shaft, and wherein a principal elastic axis extends through a point approximately 200 mm from a grip end of said shaft along said principal geometrical axis and through a point remote from said principal geometrical axis; and a club head attached to a head end of each shaft, wherein an intersection line is formed by an intersection of a front face plane of said club head and a horizontal plane when said golf club is in a normal ball addressing position, and wherein a first plane including said principal geometrical axis is parallel to said intersection line, and wherein said principal elastic axis is positioned such that a second plane including said principal elastic axis and said principal geometrical axis intersects with said first plane at an intersection angle of approximately 45 to 90 degrees, wherein said club head is divided into a front face space and a rear face space, with said first plane forming the boundary between said front face space and said rear face space, wherein said plurality of irons of different lofts includes first and second irons having lofts of less than 26 degrees and third and fourth irons having lofts of more than 36 degrees, and wherein said principal elastic axis exists in said rear face space of said first and second irons and in said front face space of said third and fourth irons.

3. The set of golf clubs according to claim 2, wherein said second iron has a loft greater than said first iron and said fourth iron has a loft greater than said third iron, and wherein said intersection angle of said first iron is greater than said intersection angle of said second iron and said intersection angle of said fourth iron is greater than said intersection angle of said third iron.

4. A set of golf clubs comprising:

a plurality of irons of different lofts;

a shaft of each of said plurality of irons formed partially of an anisotropic material of at least one of fiber reinforced resin, fiber reinforced rubber, and orientative rubber or a plurality thereof combined with each other such that a part of a fiberous or orientation angle of said anisotropic material is differentiated from other portions thereof partly in a circumferential direction of said shaft and in at least one portion in a thickness direction of said shaft, wherein a principal geometrical axis extends through said shaft, and wherein a principal elastic axis extends through a point approximately 200 mm from a grip end of said shaft along said principal geometrical axis and through a point remote from said principal geometrical axis; and a club head attached to a head end of each shaft, wherein an intersection line is formed by an intersection of a front face plane of said club head and a horizontal plane when said golf club is in a normal ball addressing position, and wherein a first plane including said principal geometrical axis is parallel to said intersection line, and wherein said principal elastic axis is positioned such that a second plane including said principal elastic axis and said principal geometrical axis intersects with said first plane at an intersection angle of approximately 45 to 90 degrees, wherein said plurality of irons of different lofts includes first and second irons having lofts of less than 26 degrees and third and fourth irons having lofts of more than 36 degrees, wherein said second iron has a loft greater than said first iron and said fourth iron has a loft greater than said third iron, and wherein said intersection angle of said first iron is greater than said intersection angle of said second iron and said intersection angle of said fourth iron is greater than said intersection angle of said third iron.

5. A set of iron clubs comprising:

a plurality of club heads in the form of irons of different lofts; and a plurality of shafts attached to respective ones of said plurality of club heads to form a plurality of iron clubs of differing lofts; wherein:

at least one iron club of said plurality of iron clubs has its shaft formed partially of an anisotropic material of at least one of fiber reinforced resin, fiber reinforced rubber, and orientative rubber or a plurality thereof combined with each other such that a part of a fiberous or orientation angle of said anisotropic material is differentiated from other portions thereof partly in a circumferential direction of said shaft and in at least one portion in a thickness direction of said shaft, wherein a principal geometrical axis extends through said shaft, and wherein a principal elastic axis extends through a first point approximately 200 mm from a grip end of said shaft along said principal geometrical axis and through a second point remote from said principal geometrical axis;

wherein said at least one iron club of said plurality of iron clubs has its club head attached to a head end of said shaft and an intersection line is formed by an intersection of a front face plane of said club head and a horizontal plane when said at least one iron club is in a normal ball addressing position, and wherein a first plane including said principal geometrical axis is parallel to said intersection line, and wherein said principal elastic axis is positioned such that a second plane including said principal elastic axis and said principal geometrical axis intersects with said first plane at an intersection angle of approximately 45 to 90 degrees, and wherein said club head is divided into a front face space and a rear face space, with said first plane forming the boundary between said front face space and said rear face space, wherein said at least one iron club includes a first iron club having a least loft of said plurality of iron clubs of differing lofts and a second iron club having a next to the least loft, and wherein said principal elastic axis exists in said rear face spaces of said first and second iron clubs' club heads, wherein said intersection angle of said first iron club is greater than said intersection angle of said second iron club.

6. A set of iron clubs comprising:

a plurality of club heads in the form of irons of different lofts; and a plurality of shafts attached to respective ones of said plurality of club heads to form a plurality of iron clubs of differing lofts; wherein:

at least one iron club of said plurality of iron clubs has its shaft formed partially of an anisotropic material of at least one of fiber reinforced resin, fiber reinforced rubber, and orientative rubber or a plurality thereof combined with each other such that a part of a fiberous or orientation angle of said anisotropic material is differentiated from other portions thereof partly in a circumferential direction of said shaft and in at least one portion in a thickness direction of said shaft, wherein a principal geometrical axis extends through said shaft, and wherein a principal elastic axis extends through a first point approximately 200 mm from a grip end of said shaft along said principal geometrical axis and through a second point remote from said principal geometrical axis;

wherein said at least one iron club of said plurality of iron clubs has its club head attached to a head end of said shaft and an intersection line is formed by an intersection of a front face plane of said club head and a horizontal plane when said at least one iron club is in a normal ball addressing position, and wherein a first plane including said principal geometrical axis is parallel to said intersection line, and wherein said principal elastic axis is positioned such that a second plane including said principal elastic axis and said principal geometrical axis intersects with said first plane at an intersection angle of approximately 45 to 90 degrees, and wherein said club head is divided into a front face space and a rear face space, with said first plane forming the boundary between said front face space and said rear face space, wherein said at least one iron club includes a first iron club having a highest loft of said plurality of iron clubs of differing lofts and a second iron club having a next to the highest loft, and wherein said principal elastic axis exists in said front face spaces of said first and second iron clubs' club heads, wherein said intersection angle of said first iron club is greater than said intersection angle of said second iron club.

7. A set of iron clubs comprising:

a plurality of club heads in the form of irons of different lofts; and a plurality of shafts attached to respective ones of said plurality of club heads to form a plurality of iron clubs of differing lofts; wherein:

at least one iron club of said plurality of iron clubs has its shaft formed partially of an anisotropic material of at least one of fiber reinforced resin, fiber reinforced rubber, and orientative rubber or a plurality thereof combined with each other such that a part of a fiberous or orientation angle of said anisotropic material is differentiated from other portions thereof partly in a circumferential direction of said shaft and in at least one portion in a thickness direction of said shaft, wherein a principal geometrical axis extends through said shaft, and wherein a principal elastic axis extends through a first point approximately 200 mm from a grip end of said shaft along said principal geometrical axis and through a second point remote from said principal geometrical axis;

wherein said at least one iron club of said plurality of iron clubs has its club head attached to a head end of said shaft and an intersection line is formed by an intersection of a front face plane of said club head and a horizontal plane when said at least one iron club is in a normal ball addressing position, and wherein a first plane including said principal geometrical axis is parallel to said intersection line, and wherein said principal elastic axis is positioned such that a second plane including said principal elastic axis and said principal geometrical axis intersects with said first plane at an intersection angle of approximately 45 to 90 degrees, and wherein said club head is divided into a front face space and a rear face space, with said first plane forming the boundary between said front face space and said rear face space, wherein said at least one iron club is a first iron club having a least loft of said plurality of iron clubs of differing lofts and a second iron club having a highest loft, and wherein said principal elastic axis exists in said rear face space of said first iron club's club head and in a front face space of said second iron club's club head.

8. A set of iron clubs comprising:

a plurality of club heads in the form of irons of different lofts; and a plurality of shafts attached to respective ones of said plurality of club heads to form a plurality of iron clubs of differing lofts; wherein:

at least one iron club of said plurality of iron clubs has its shaft formed partially of an anisotropic material of at least one of fiber reinforced resin, fiber reinforced rubber, and orientative rubber or a plurality thereof combined with each other such that a part of a fiberous or orientation angle of said anisotropic material is differentiated from other portions thereof partly in a circumferential direction of said shaft and in at least one portion in a thickness direction of said shaft, wherein a principal geometrical axis extends through said shaft, and wherein a principal elastic axis extends through a first point approximately 200 mm from a grip end of said shaft along said principal geometrical axis and through a second point remote from said principal geometrical axis;

wherein said at least one iron club of said plurality of iron clubs has its club head attached to a head end of said shaft and an intersection line is formed by an intersection of a front face plane of said club head and a horizontal plane when said at least one iron club is in a normal ball addressing position, and wherein a first plane including said principal geometrical axis is parallel to said intersection line, and wherein said principal elastic axis is positioned such that a second plane including said principal elastic axis and said principal geometrical axis intersects with said first plane at an intersection angle of approximately 45 to 90 degrees, and wherein said club head is divided into a front face space and a rear face space, with said first plane forming the boundary between said front face space and said rear face space, wherein said at least one iron club includes a first iron club having a least loft of said plurality of iron clubs of differing lofts, a second iron club having a highest loft and a third iron club having a next to the highest loft, and wherein said principal elastic axis exists in said rear face space of said first iron club's club head and exists in said front face spaces of said second and third iron clubs' club heads.

9. A set of iron clubs comprising:

a plurality of club heads in the form of irons of different lofts; and a plurality of shafts attached to respective ones of said plurality of club heads to form a plurality of iron clubs of differing lofts; wherein:

at least one iron club of said plurality of iron clubs has its shaft formed partially of an anisotropic material of at least one of fiber reinforced resin, fiber reinforced rubber, and orientative rubber or a plurality thereof combined with each other such that a part of a fiberous or orientation angle of said anisotropic material is differentiated from other portions thereof partly in a circumferential direction of said shaft and in at least one portion in a thickness direction of said shaft, wherein a principal geometrical axis extends through said shaft, and wherein a principal elastic axis extends through a first point approximately 200 mm from a grip end of said shaft along said principal geometrical axis and through a second point remote from said principal geometrical axis;

wherein said at least one iron club of said plurality of iron clubs has its club head attached to a head end of said shaft and an intersection line is formed by an intersection of a front face plane of said club head and a horizontal plane when said at least one iron club is in a normal ball addressing position, and wherein a first plane including said principal geometrical axis is parallel to said intersection line, and wherein said principal elastic axis is positioned such that a second plane including said principal elastic axis and said principal geometrical axis intersects with said first plane at an intersection angle of approximately 45 to 90 degrees, and wherein said club head is divided into a front face space and a rear face space, with said first plane forming the boundary between said front face space and said rear face space, wherein said at least one iron club includes a first iron club having a least loft of said plurality of iron clubs of differing lofts, a second iron club having a next to the least loft, and a third iron club having a highest loft, and wherein said principal elastic axis exists in said rear face spaces of said first and second iron clubs' club heads, and exists in said front face space of said third iron club's club head.

10. A set of iron clubs comprising:

a plurality of club heads in the form of irons of different lofts; and a plurality of shafts attached to respective ones of said plurality of club heads to form a plurality of iron clubs of differing lofts; wherein:

at least one iron club of said plurality of iron clubs has its shaft formed partially of an anisotropic material of at least one of fiber reinforced resin, fiber reinforced rubber, and orientative rubber or a plurality thereof combined with each other such that a part of a fiberous or orientation angle of said anisotropic material is differentiated from other portions thereof partly in a circumferential direction of said shaft and in at least one portion in a thickness direction of said shaft, wherein a principal geometrical axis extends through said shaft, and wherein a principal elastic axis extends through a first point approximately 200 mm from a grip end of said shaft along said principal geometrical axis and through a second point remote from said principal geometrical axis;

wherein said at least one iron club of said plurality of iron clubs has its club head attached to a head end of said shaft and an intersection line is formed by an intersection of a front face plane of said club head and a horizontal plane when said at least one iron club is in a normal ball addressing position, and wherein a first plane including said principal geometrical axis is parallel to said intersection line, and wherein said principal elastic axis is positioned such that a second plane including said principal elastic axis and said principal geometrical axis intersects with said first plane at an intersection angle of approximately 45 to 90 degrees, and wherein said club head is divided into a front face space and a rear face space, with said first plane forming the boundary between said front face space and said rear face space, wherein said at least one iron club includes a first iron club having a least loft of said plurality of iron clubs of differing lofts, a second iron club having a next to the least loft, a third iron club having a highest loft, and a fourth iron club having a next to the highest loft, and wherein said principal elastic axis exists in said rear face spaces of said first and second iron clubs' club heads, and exists in said front face spaces of said third and fourth iron clubs' club heads.

* * * * *